US009624060B2

(12) United States Patent
Denley

(10) Patent No.: US 9,624,060 B2
(45) Date of Patent: Apr. 18, 2017

(54) APPARATUS FOR DOCUMENT HANDLING

(71) Applicant: INTELLIGENT DEPOSIT SYSTEMS LIMITED, Cardiff (GB)

(72) Inventor: Andrew Denley, Coventry (GB)

(73) Assignee: INTELLIGENT DEPOSIT SYSTEMS LIMITED, Cardiff (GB)

( * ) Notice: Subject to any disclaimer, the term of this patent is extended or adjusted under 35 U.S.C. 154(b) by 0 days.

(21) Appl. No.: 14/426,688

(22) PCT Filed: Sep. 5, 2013

(86) PCT No.: PCT/GB2013/052322

§ 371 (c)(1),
(2) Date: Mar. 6, 2015

(87) PCT Pub. No.: WO2014/037723

PCT Pub. Date: Mar. 13, 2014

(65) Prior Publication Data

US 2015/0239701 A1 Aug. 27, 2015

(30) Foreign Application Priority Data

Sep. 6, 2012 (GB) ..... 1215936.4

(51) Int. Cl.

| | |
|---|---|
| ***B65H 1/08*** | (2006.01) |
| ***B65H 31/04*** | (2006.01) |
| ***B65H 31/12*** | (2006.01) |
| ***B65H 31/18*** | (2006.01) |

(Continued)

(52) U.S. Cl.

CPC ..... *B65H 31/04* (2013.01); *B65H 29/46* (2013.01); *B65H 29/58* (2013.01); *B65H 31/12* (2013.01); *B65H 31/18* (2013.01); *B65H 2402/344* (2013.01); *B65H 2403/533* (2013.01); *B65H 2701/1912* (2013.01)

(58) Field of Classification Search

CPC ..... B65H 29/46; B65H 29/58; B65H 31/04; B65H 31/12; B65H 31/18; B65H 2402/344; B65H 2701/1912; B65H 2403/533

See application file for complete search history.

(56) References Cited

U.S. PATENT DOCUMENTS

| | | | | |
|---|---|---|---|---|
| 2006/0157918 | A1* | 7/2006 | Gaber | B65H 29/46 271/180 |
| 2010/0289211 | A1* | 11/2010 | Nireki | B65H 5/062 271/226 |

(Continued)

FOREIGN PATENT DOCUMENTS

| | | | |
|---|---|---|---|
| FR | 2453811 | A1 | 11/1980 |
| JP | S54100062 | A | 8/1979 |
| WO | 2009106856 | A1 | 9/2009 |

*Primary Examiner* — Prasad Gokhale
(74) *Attorney, Agent, or Firm* — Avery N. Goldstein; Blue Filament Law PLLC

(57) ABSTRACT

The present invention relates to an improved apparatus for handling documents, such as currency, for example bank notes. A plunger (5) comprises a body (571) and a base (579) such that when the plunger is deployed to urge documents into a securable container, the plunger moves between a fully retracted position and an intermediate position with the base (579) and body (571) together, and between the intermediate position and a fully advanced position the base (579) is displaced from the body (571).

9 Claims, 24 Drawing Sheets

(51) Int. Cl.
*B65H 29/46* (2006.01)
*B65H 29/58* (2006.01)

(56) References Cited

U.S. PATENT DOCUMENTS

2013/0334767 A1* 12/2013 Zhao ..... B65H 29/12
271/198
2014/0314462 A1* 10/2014 Bryl ..... B65H 31/10
399/405

* cited by examiner

APPARATUS FOR DOCUMENT HANDLING

The present invention relates to an apparatus for handling documents, such as currency, for example bank notes. More specifically, although not exclusively, the present invention relates to improvements to an apparatus for accurately and securely transferring currency from one location to another.

Businesses such as retail vendors, casinos and the like are burdened with the laborious task of counting and handling money taken through their activities. The costs associated with this task are significant owing to the labour required to reconcile, transport, handle and bank or deposit the funds. Whilst it is not common, businesses also face the possibility that staff or other persons will steal handled money.

For example, casinos offer a wide selection of table games, such as Blackjack, Roulette and Poker, and will generally allow players to pay in cash at the table. In such instances the table will generally include a drop box, which usually consists of a metal box fastened to the underside of the table and may include a removable secure inner cash sleeve. The cash is first counted by the casino employee, e.g. the dealer, the amount is agreed with the client, e.g. the player, and then the cash is inserted into the drop box.

Casinos in the UK generally transfer all cash drop boxes from their gaming tables to the vault at the time of closing. The funds are meticulously counted twice by a number of individuals to ensure an accurate count. This process generally takes 3 to 6 hours and requires strict security measures.

Similarly, all businesses which are required to handle physical funds provided by customers must carry out such laborious and costly tasks to some extent.

In the case of business where there are significant quantities of currency, it is important that the currency does not become jammed in a counting apparatus. It is also important that the currency remains disposed generally planar while travelling through the document handling apparatus and do not become furled, folded or similar, which may lead to entrapment within the apparatus and jamming of the machine or damage to the currency document. Further there is a risk that the currency documents may during transport become entrained or otherwise trapped in the mechanism as the currency documents pass along the document transfer apparatus.

It is an advantage of the present invention that an improved apparatus is provided in which these problems are addressed.

According to a first aspect of the invention there is provided a plunger for urging in use documents into a securable container, the plunger being moveable between a first retracted position and a second advanced position, wherein the plunger comprises at least a first portion and a second portion, the plunger being moveable in a first stage between a first retracted position and an intermediate position, the second portion of the plunger then becoming displaced from the first portion of the plunger at the second position, the second portion of the plunger thereafter being moveable in a second stage from the intermediate position to the second advanced position.

Preferably the first portion of the plunger comprises a body and the second portion of the plunger comprises a base.

Preferably the plunger further comprises a first scissor mechanism and a connecting member acted on by the first scissor mechanism to move the second portion of the plunger with respect to the first portion of the plunger.

Preferably the plunger further comprises a plurality of displaceable levers located within the first portion of the plunger, retained within the first portion of the plunger during the first stage of movement of the plunger, and adapted to be displaced through a side wall of the first portion of the plunger as the second portion of the plunger is moved to the second advanced portion of the plunger is moved to the second advanced position. Preferably at least one of the levers is provided with an operational surface aligned with the side wall of the first portion of the plunger during the first stage of plunger movement and displaced from alignment during the second stage of plunger movement.

According to a second aspect of the invention there is provided a plunger for urging in use documents into a securable container, the plunger being moveable between a first retracted position and a second advanced position, wherein the plunger comprises a plurality of displaceable levers moveable between a first position in which an operational surface is aligned with the side surfaces of the plunger and a second position in which the operational surface is displaced from alignment with the side surface of the plunger.

Preferably the plunger further comprises a connecting member and a first scissor mechanism, relative movement of the first scissor mechanism and the connector member causing the operational surface to be displaced.

Preferably the plunger further comprises a first portion and a second portion, the relative movement of the first scissor mechanism and the connector member causes the first portion of the plunger and the second portion of the plunger to be displaced relative to one another, causing the operational surface to be displaced.

Preferably the plurality of displaceable levers is located within the first portion of the plunger and the operational surface is aligned with, and displaced from alignment with a side surface of the first portion of the plunger.

Preferably the second portion of the plunger is provided with shoulders to contact the plurality of levers to displace the operational surface.

According to a third aspect of the invention there is provided a plunger for urging in use a stack of documents from a movable container into a securable container, the plunger being moveable between a first retracted position and a second advanced position, wherein the plunger further comprises alignment means, the alignment means adapted in use to move between a first stowed position and a second deployed position, wherein in the first stowed position a base of the alignment means is displaced vertically a first distance from a base of the plunger and in the second deployed position the base of the alignment means is displaced a second distance from the base of the plunger, the second distance being less than the first distance.

Preferably, in the second deployed position the base of the alignment means is substantially level with the base of the plunger.

Preferably in the second deployed position at least a part of the base of the alignment means is also seated against the moveable container, and more preferably against an upper edge of the moveable container. Even more preferably the part of the base of the alignment means is located within a recessed portion of the upper edge of the moveable container.

According to a fourth aspect of the invention there is provided a plunger for urging in use documents into a securable container, the plunger being moveable between a first retracted position and a second advanced position, wherein the plunger includes a plurality of wipers, movable with respect to the plunger, wherein the one or more wipers are formed from first and second members coupled for relative rotation about an axis, each of the first and second members having first and second wipers extending at respective first and second ends thereof, in which the first member is seated on the second member.

Preferably one of first and second members is provided with a boss and collar and the other of the first and second members is provided with an opening and a recess such that the boss passes through the opening and the collar is seated within the recess.

More preferably the boss and collar extend from the member in a direction opposite to that of the respective wiper.

According to a fifth aspect of the invention there is provided a plunger for urging in use documents into a securable container, the plunger being moveable between a first retracted position and a second advanced position, wherein the plunger includes a wiper assembly comprising a plurality of wipers, the wipers of the wiper assembly being adapted to be displaced rotationally with respect to one another, in which the wiper assembly is adapted to be movable with respect to the base of the plunger.

Preferably the wiper assembly is biased towards a preferred position. It will be understood that the various aspects of the invention may be combined with one another as desired.

Aspects of the invention will now be described, by way of example only, with reference to the accompanying drawings in which.

Figure 4A:
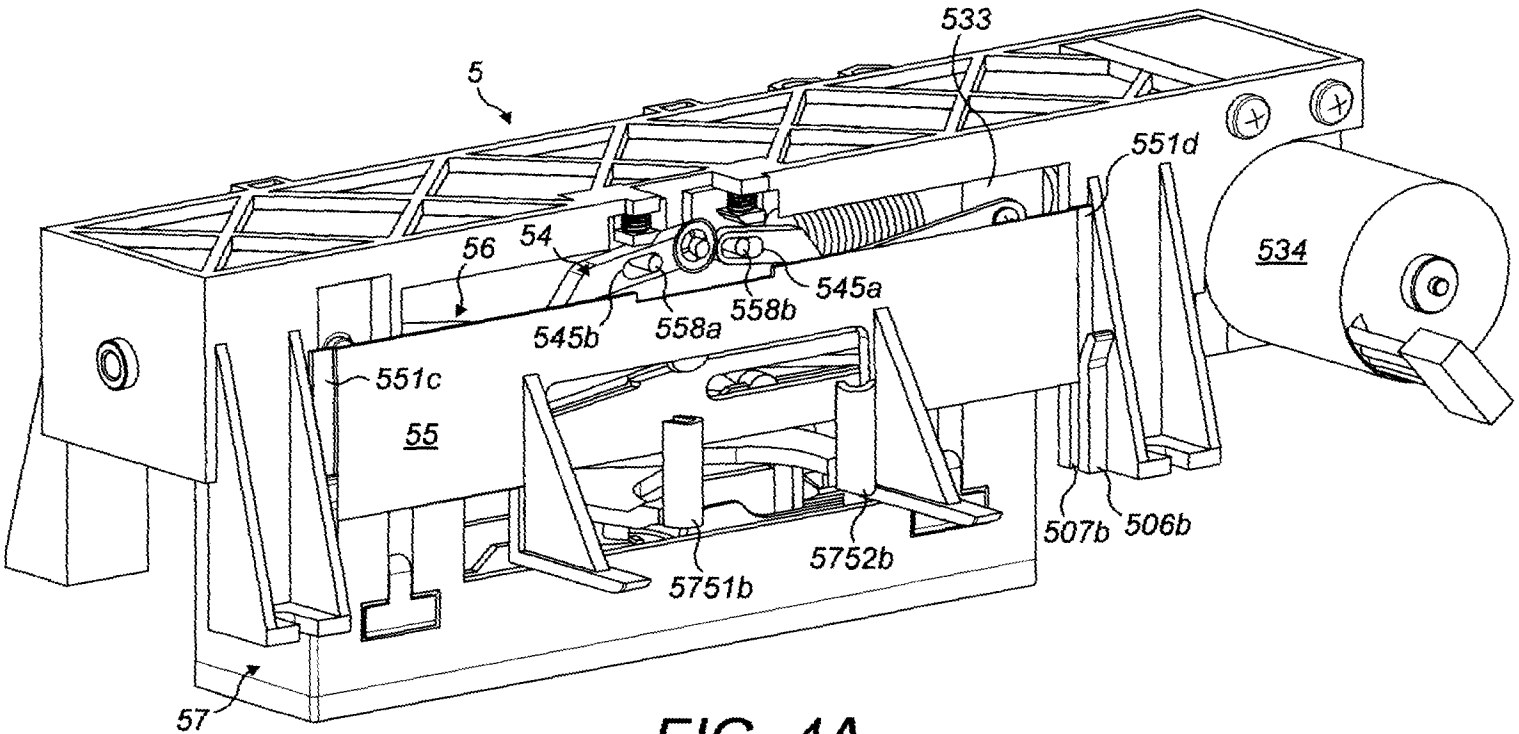
FIG. 4A is a perspective view of a plunger of the apparatus of FIG. 1, the plunger being shown in a first position.
Figure 4B:
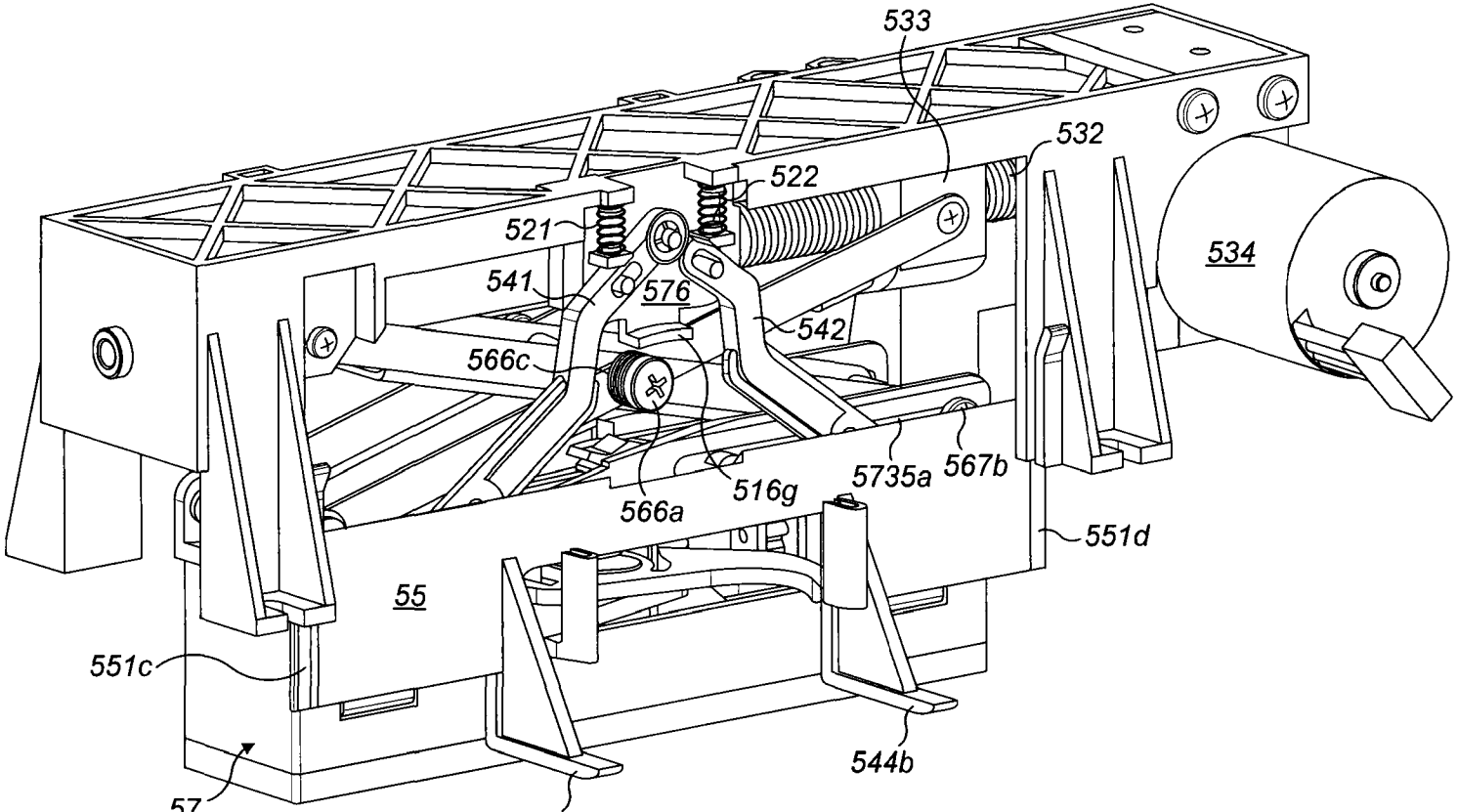
FIG. 4B is a perspective view of the plunger of FIG. 4A shown in a second position.
Figure 4C:
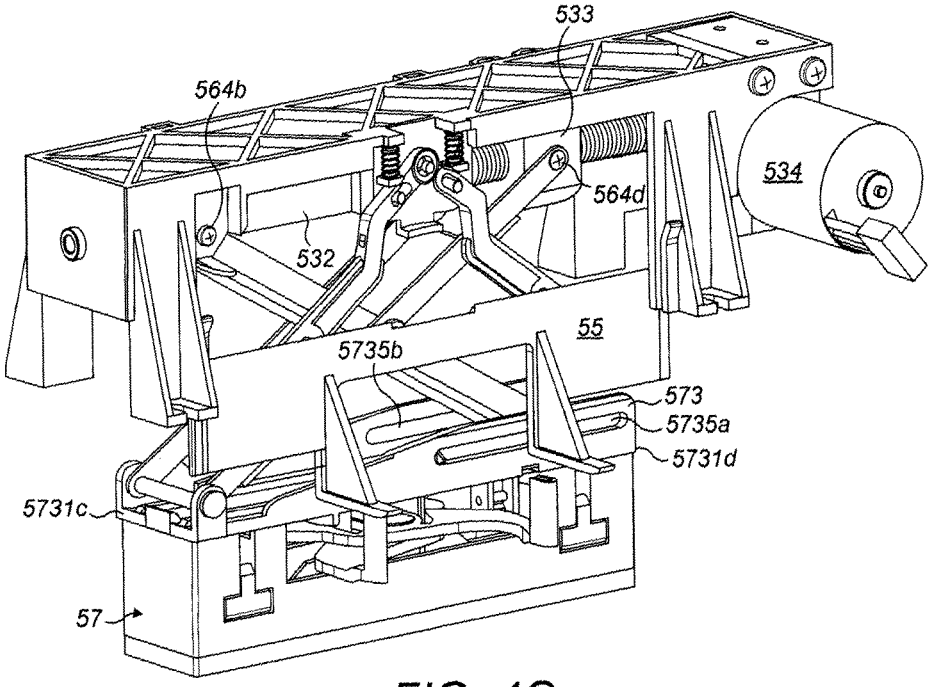
FIG. 4C is a perspective view of the plunger shown in a third position.
Figure 4D:
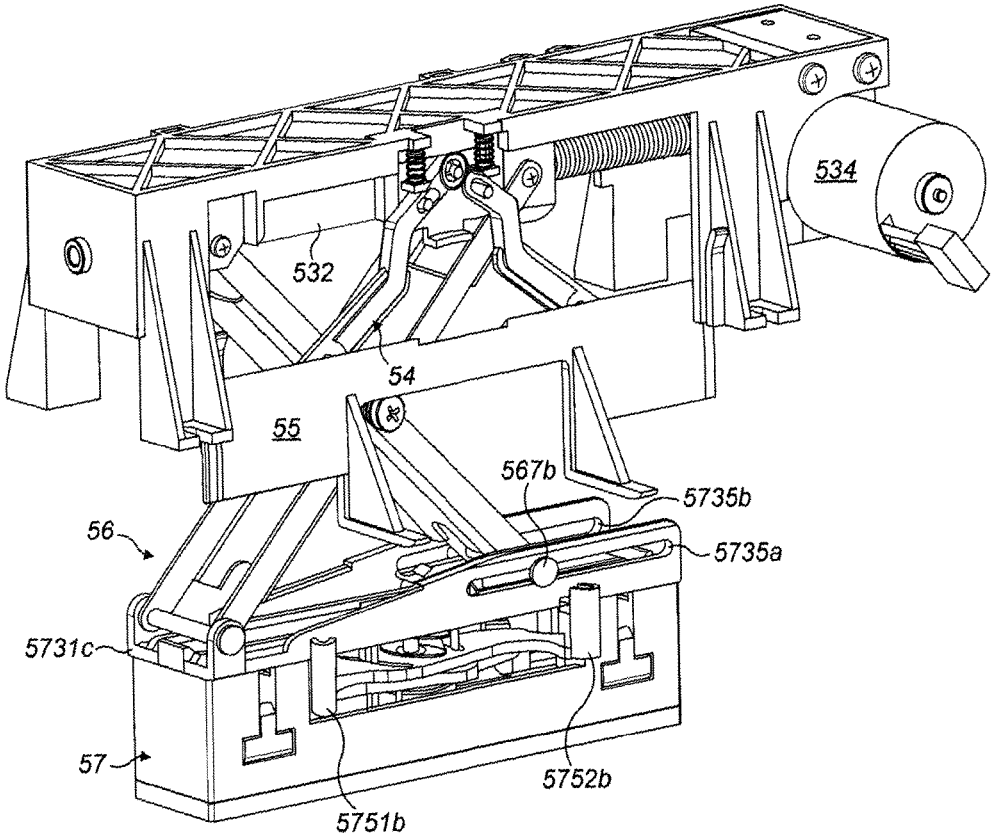
FIG. 4D is a perspective view of the plunger shown in a fourth position.
Figure 4E:
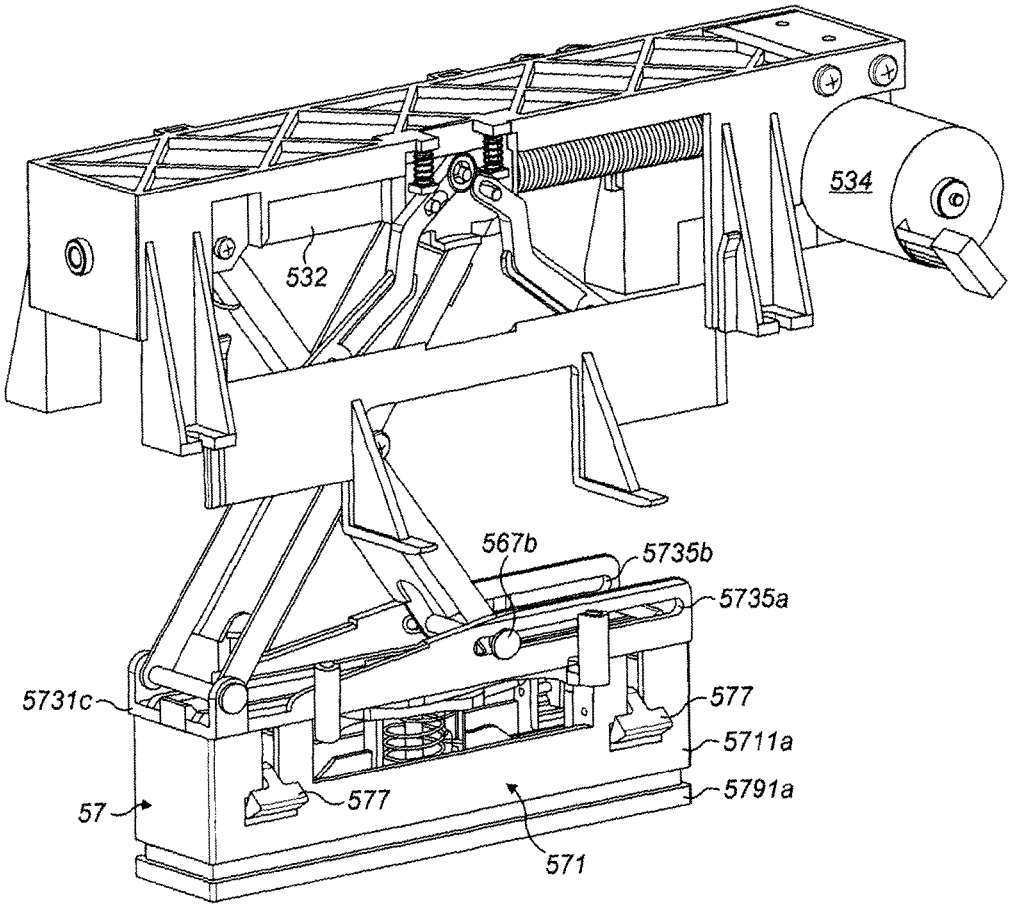
FIG. 4E is a perspective view of the plunger shown in a fifth position.
Figure 4F:
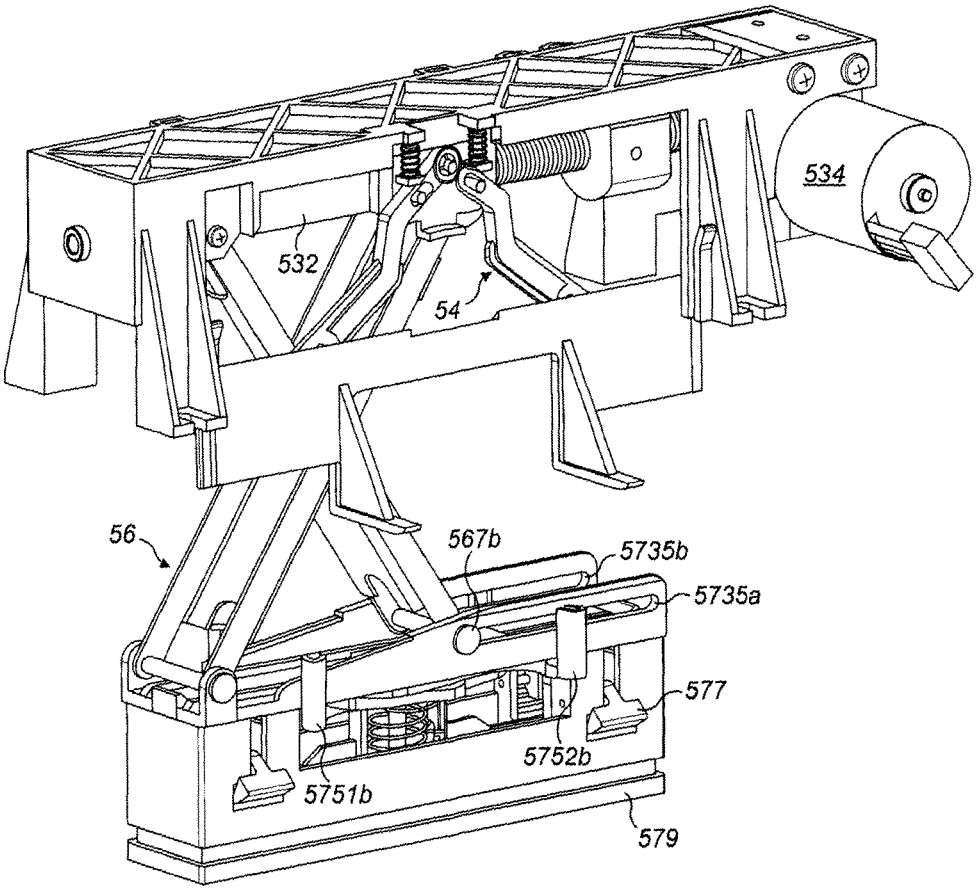
FIG. 4F is a perspective view of the plunger shown in a sixth position.
Figure 5A:
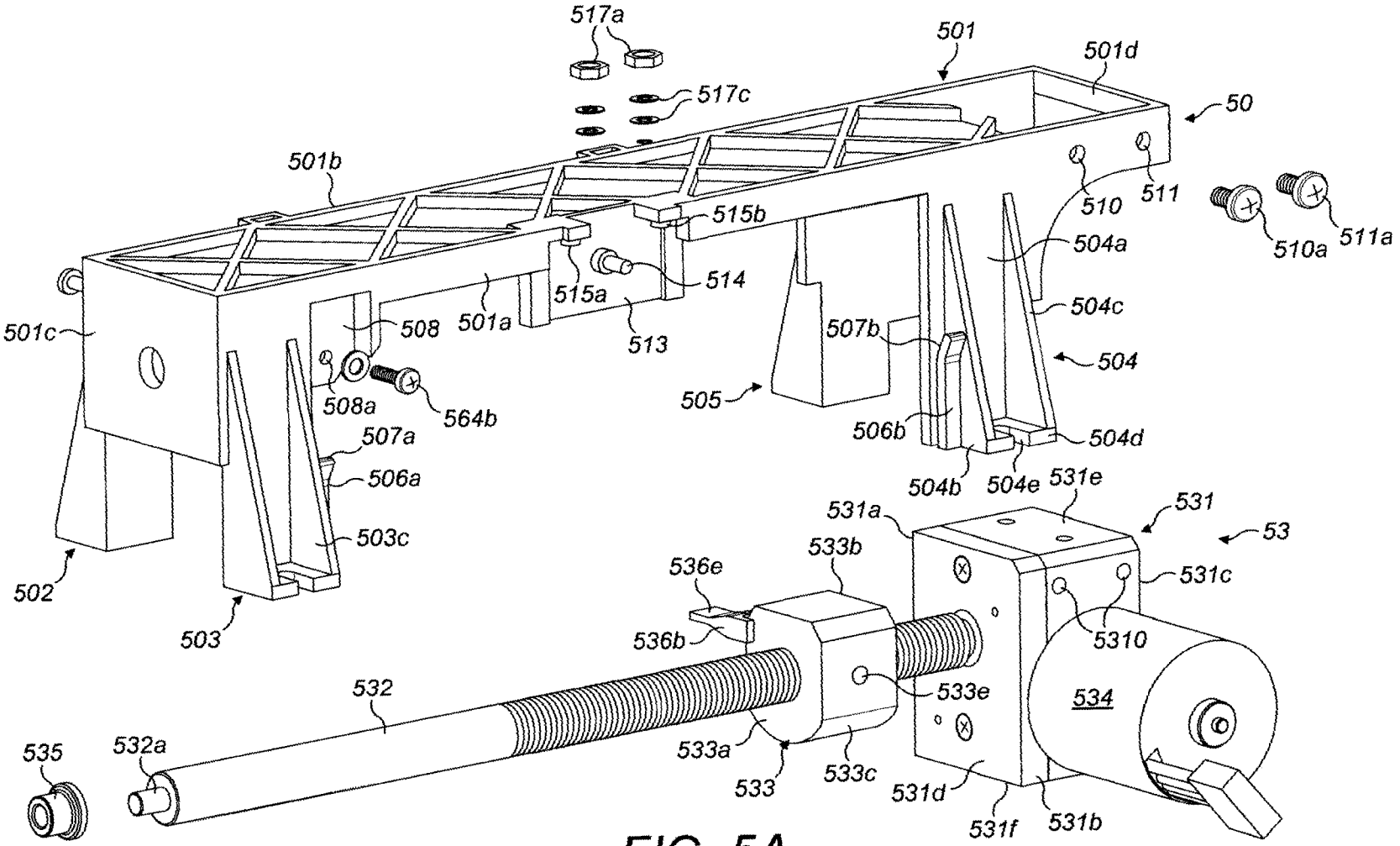
Figure 5B:
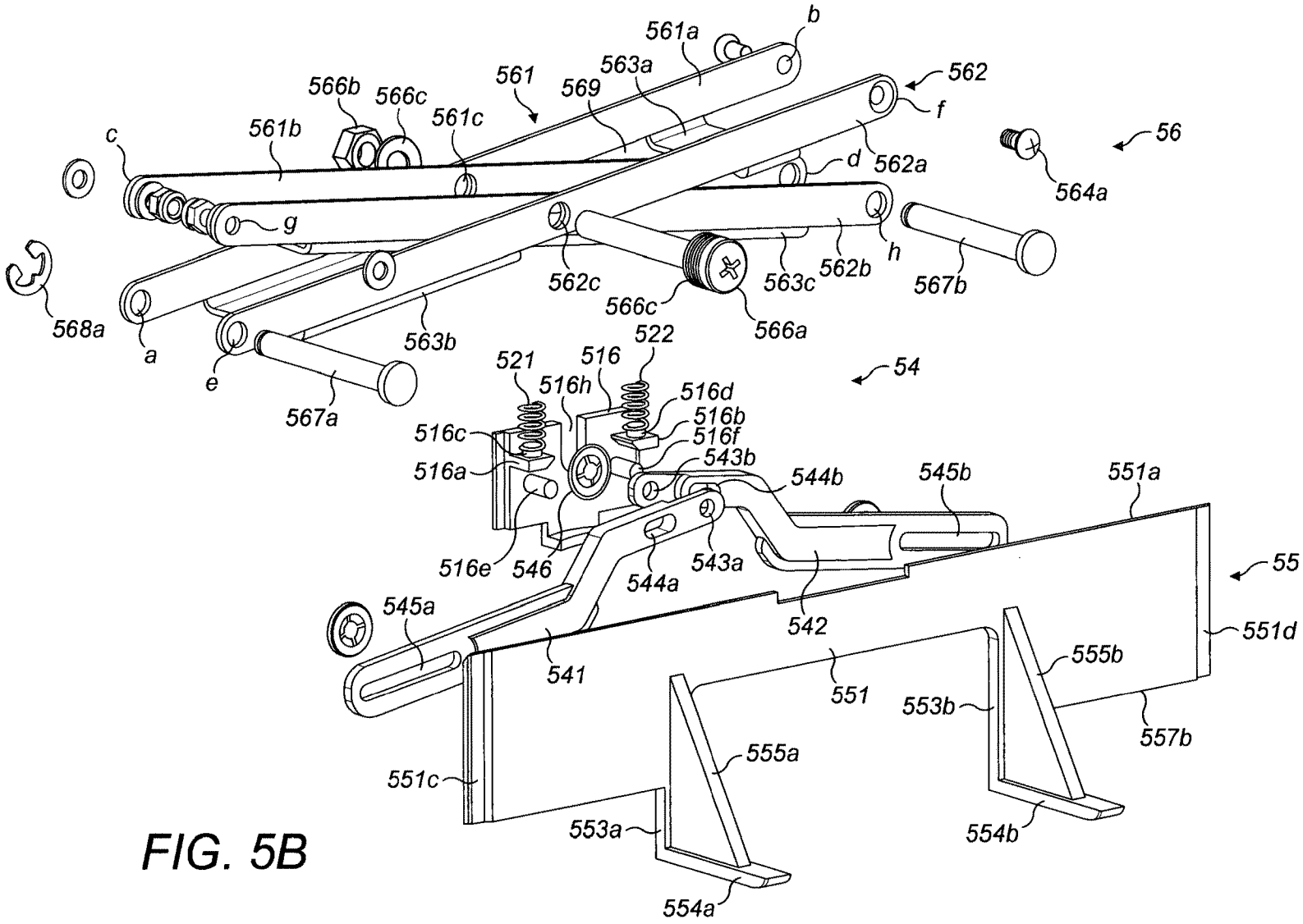
Figure 6A:
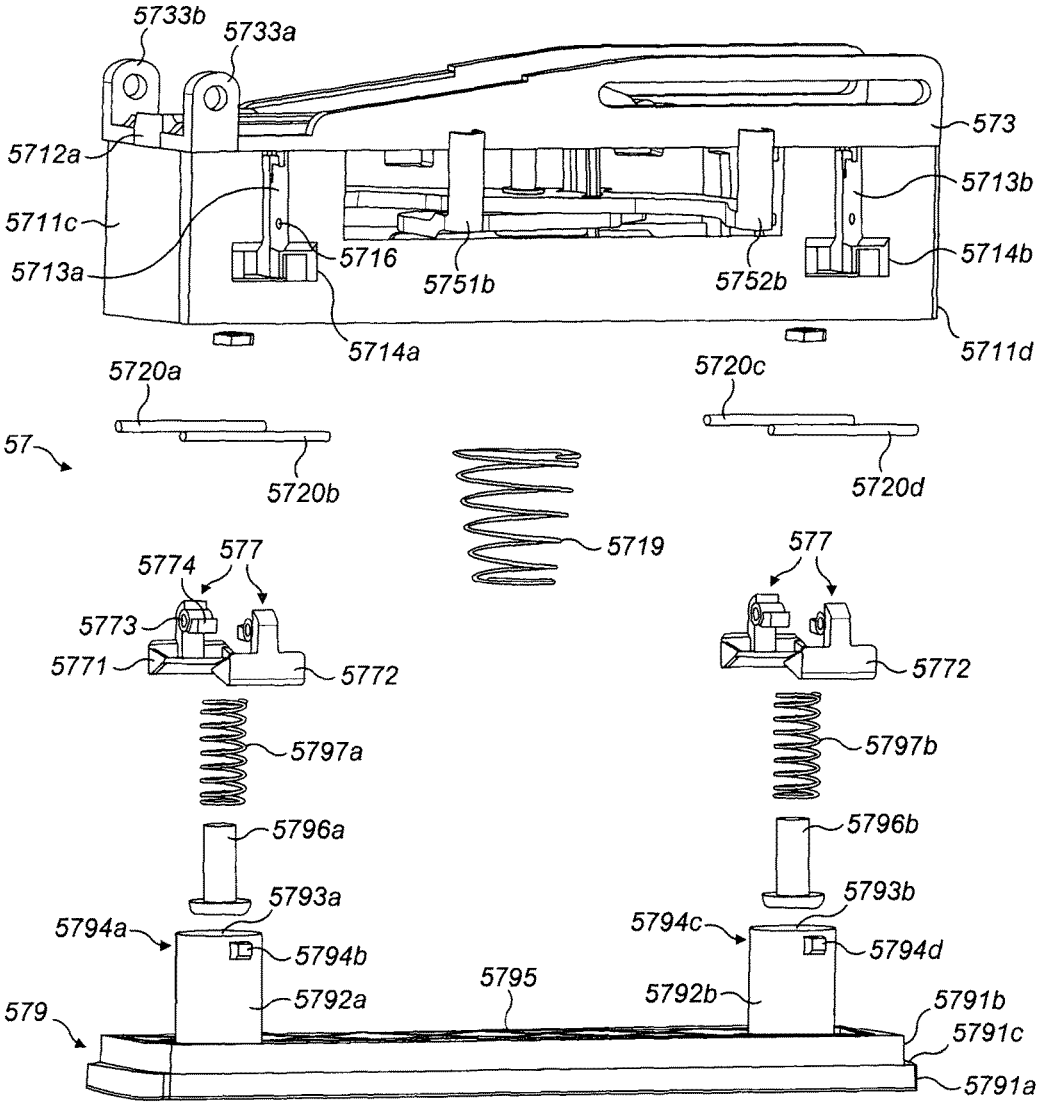
Figure 6B:
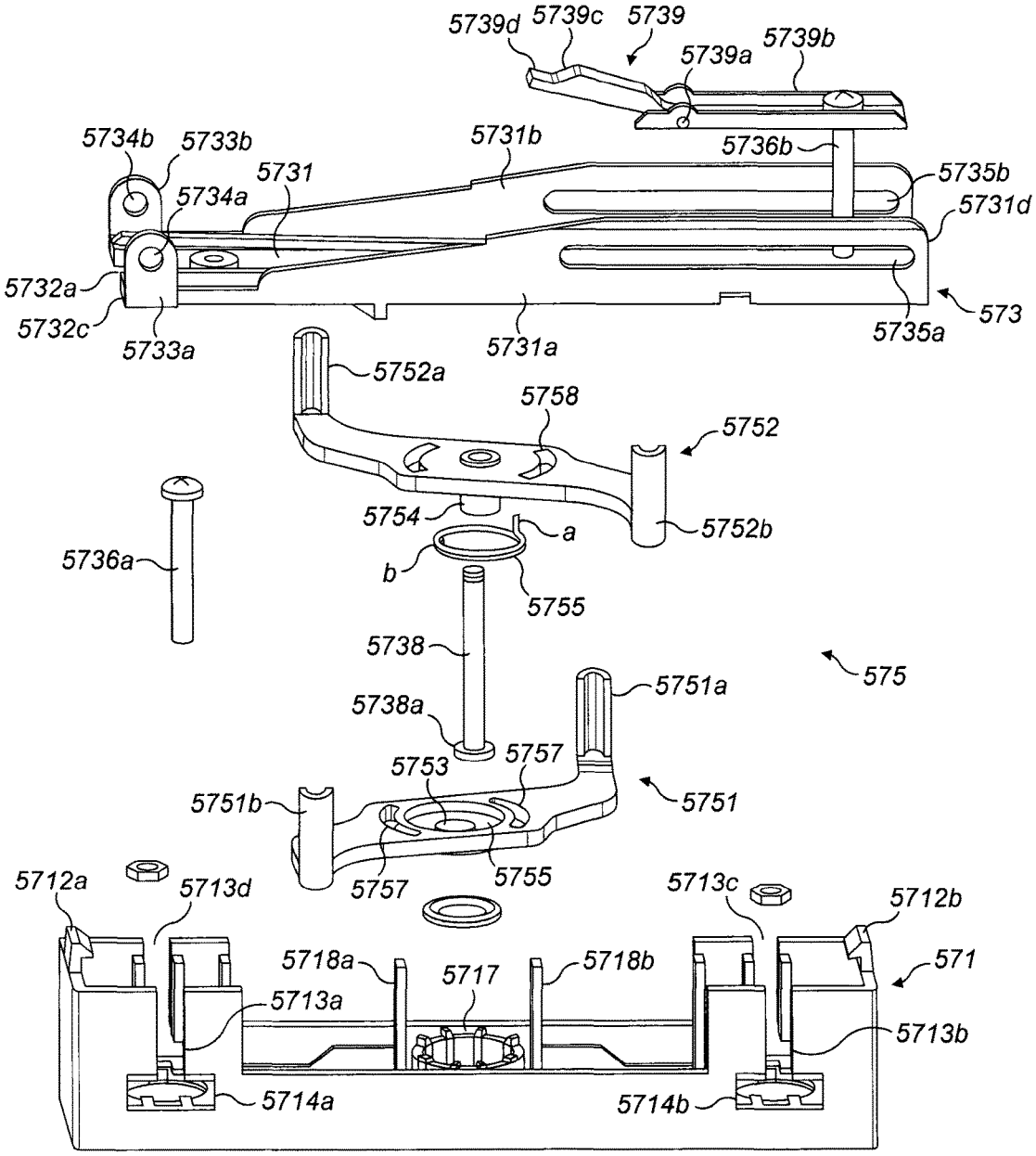
Figure 7:
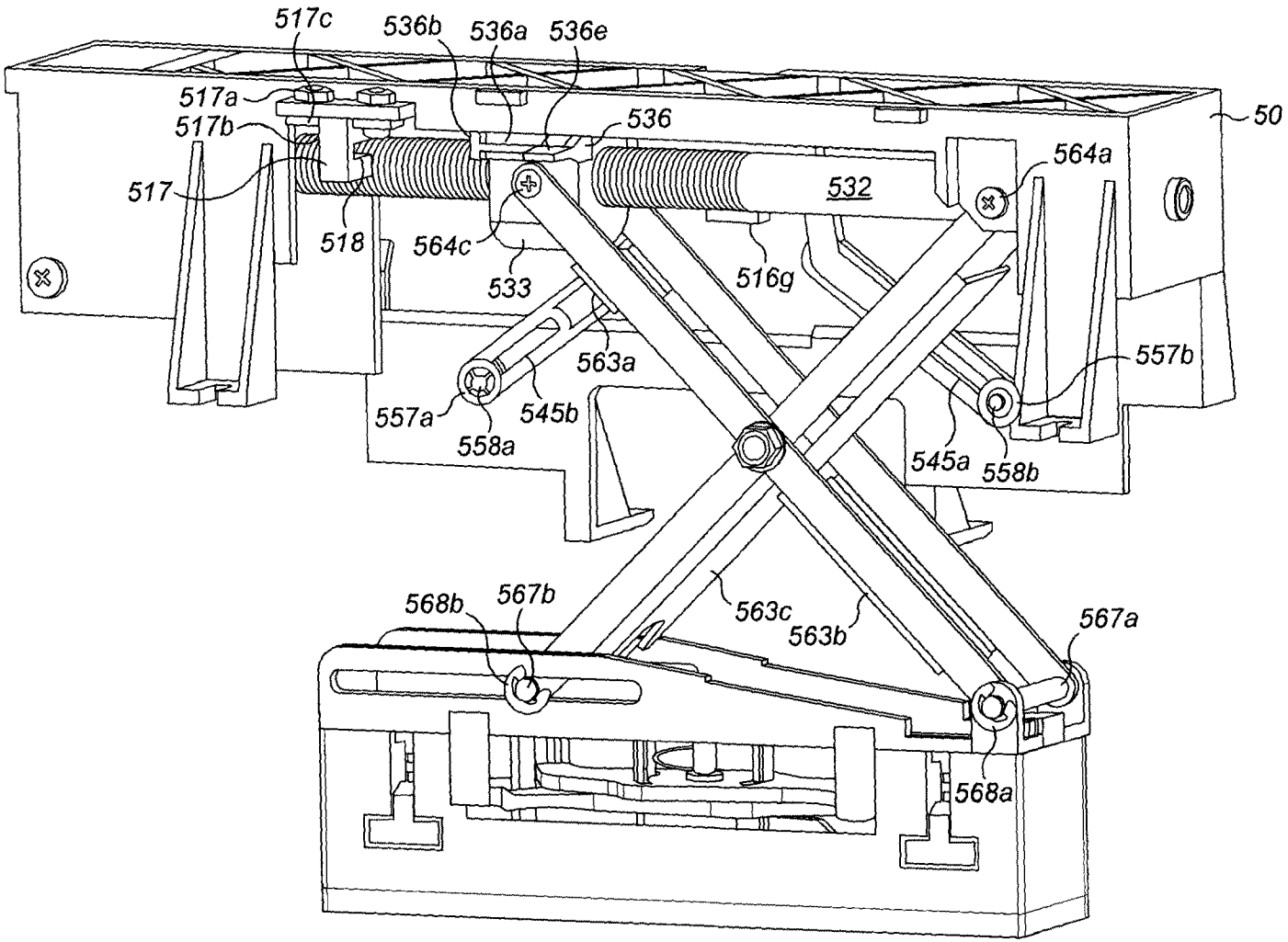
Figure 8:
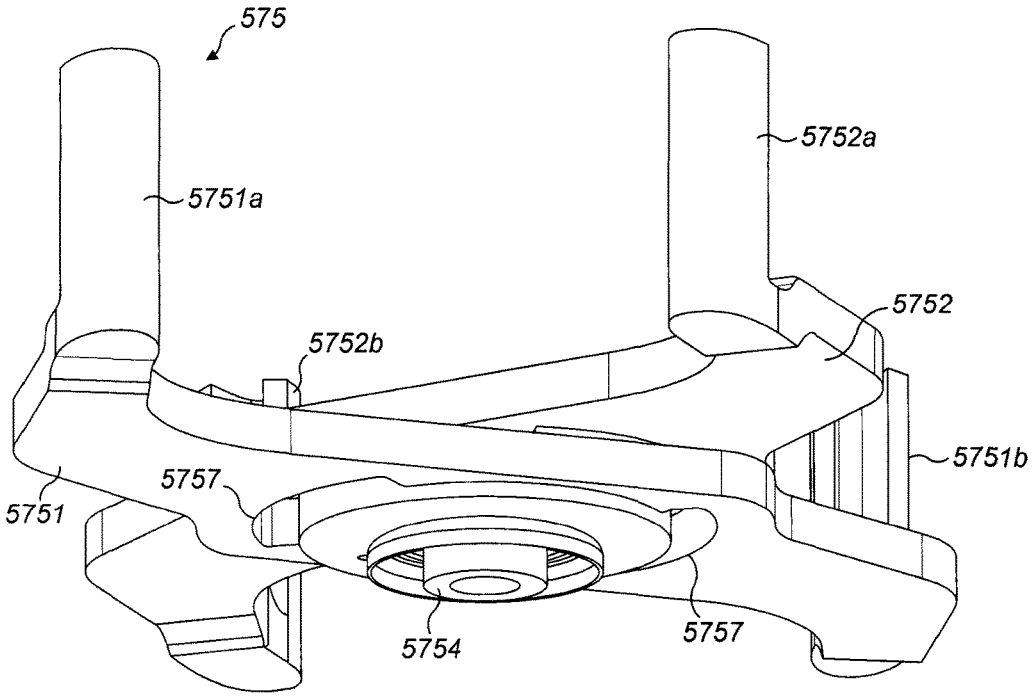
Figure 9:
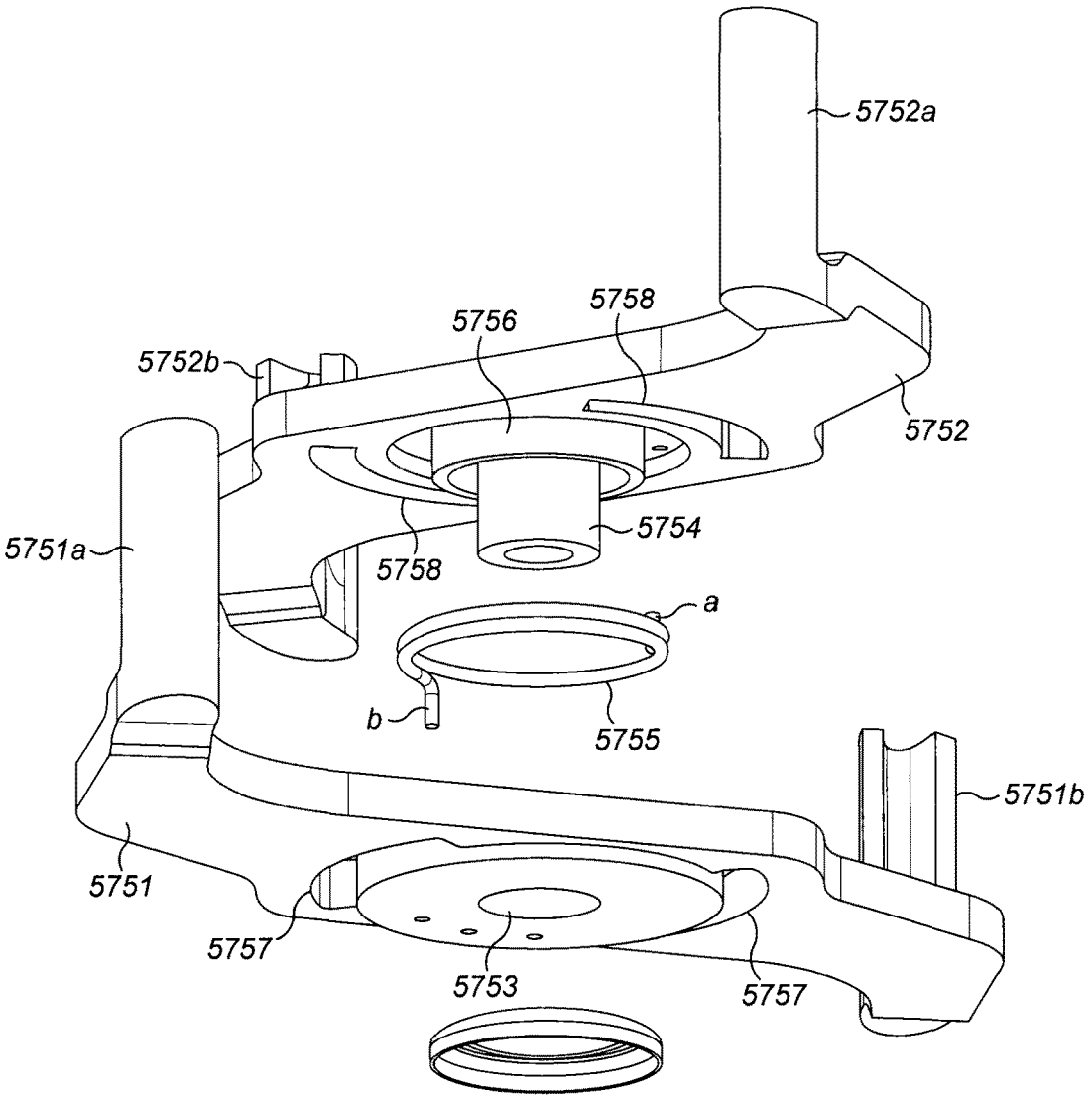
Figure 10:
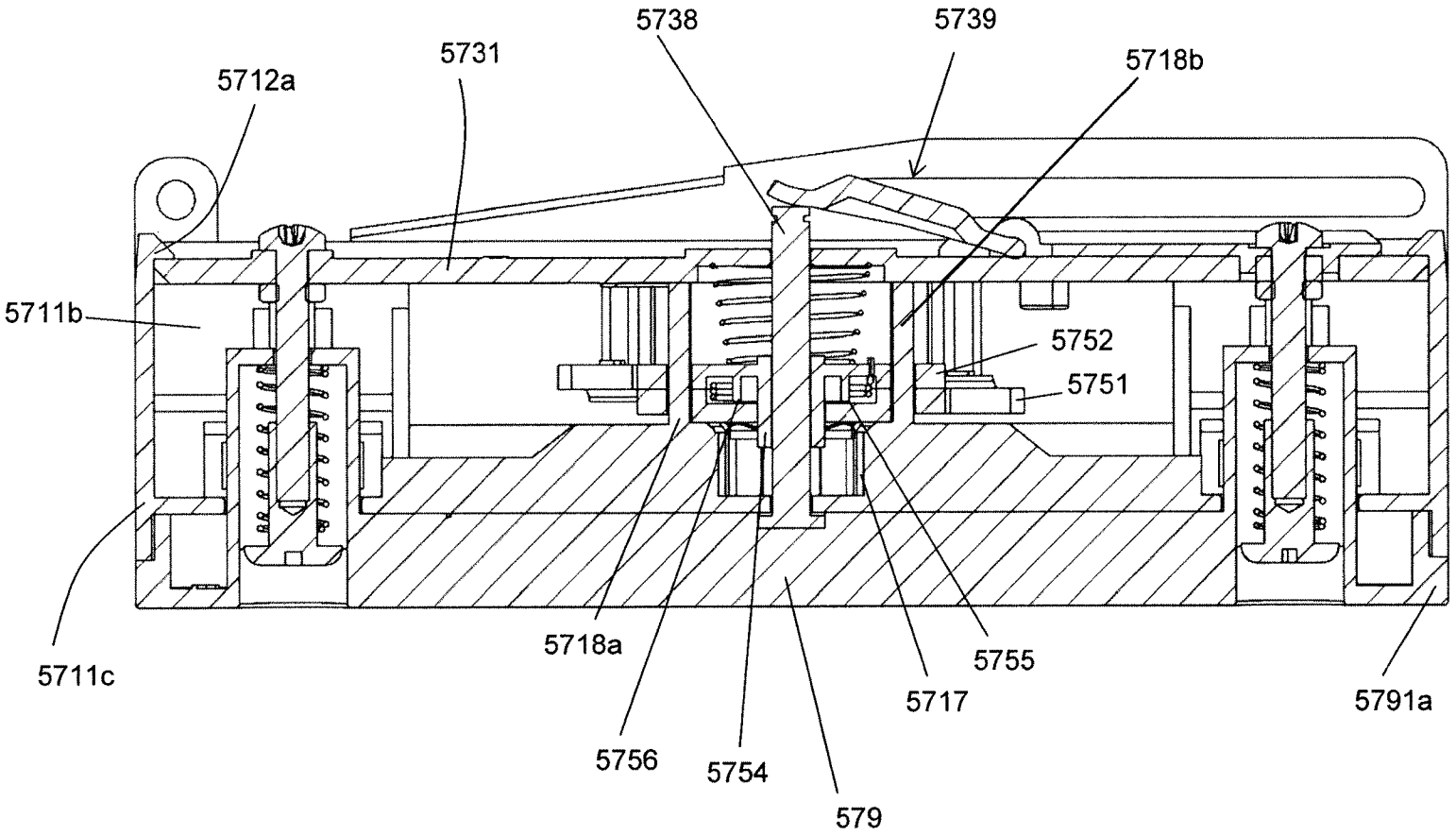
Figure 11:
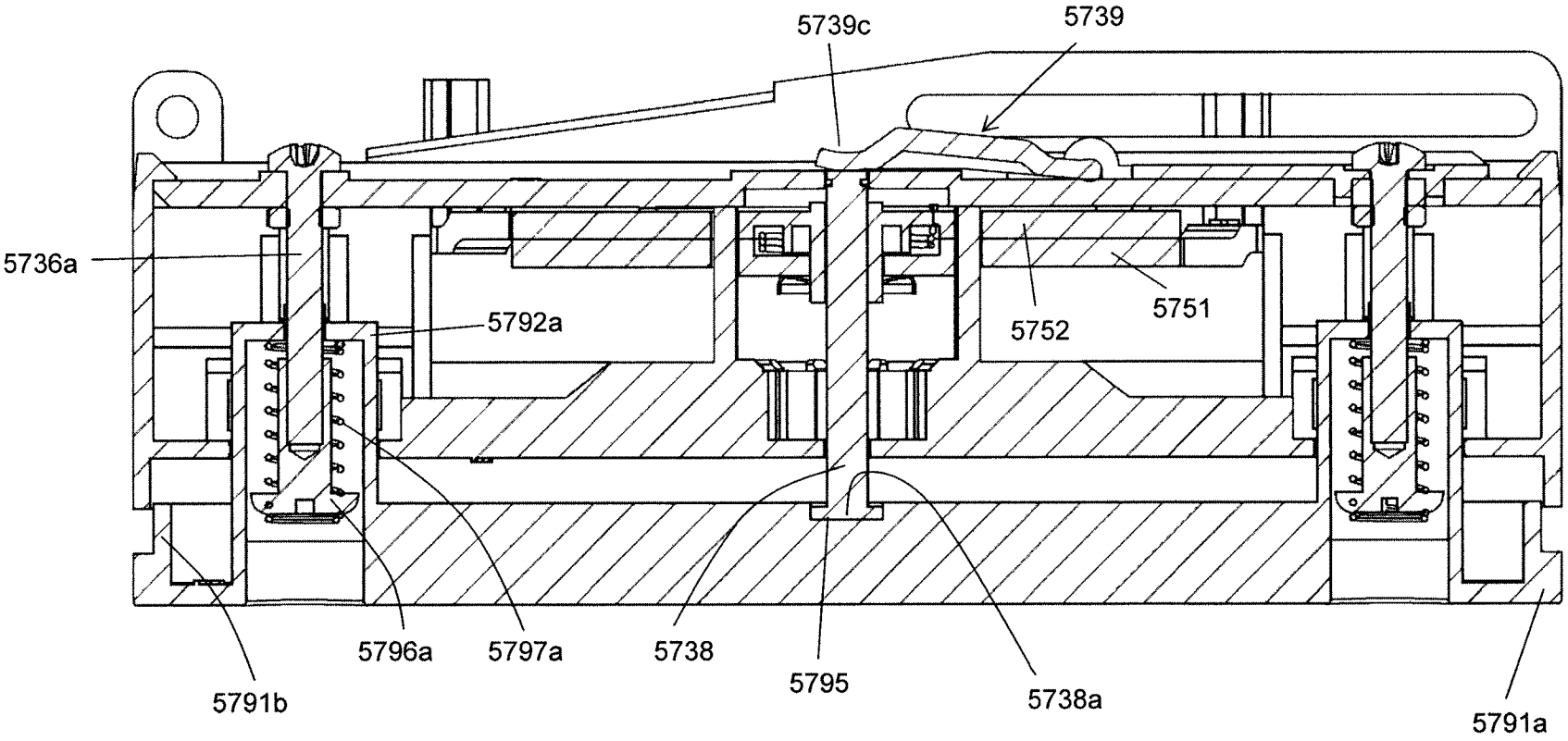
Figure 12:
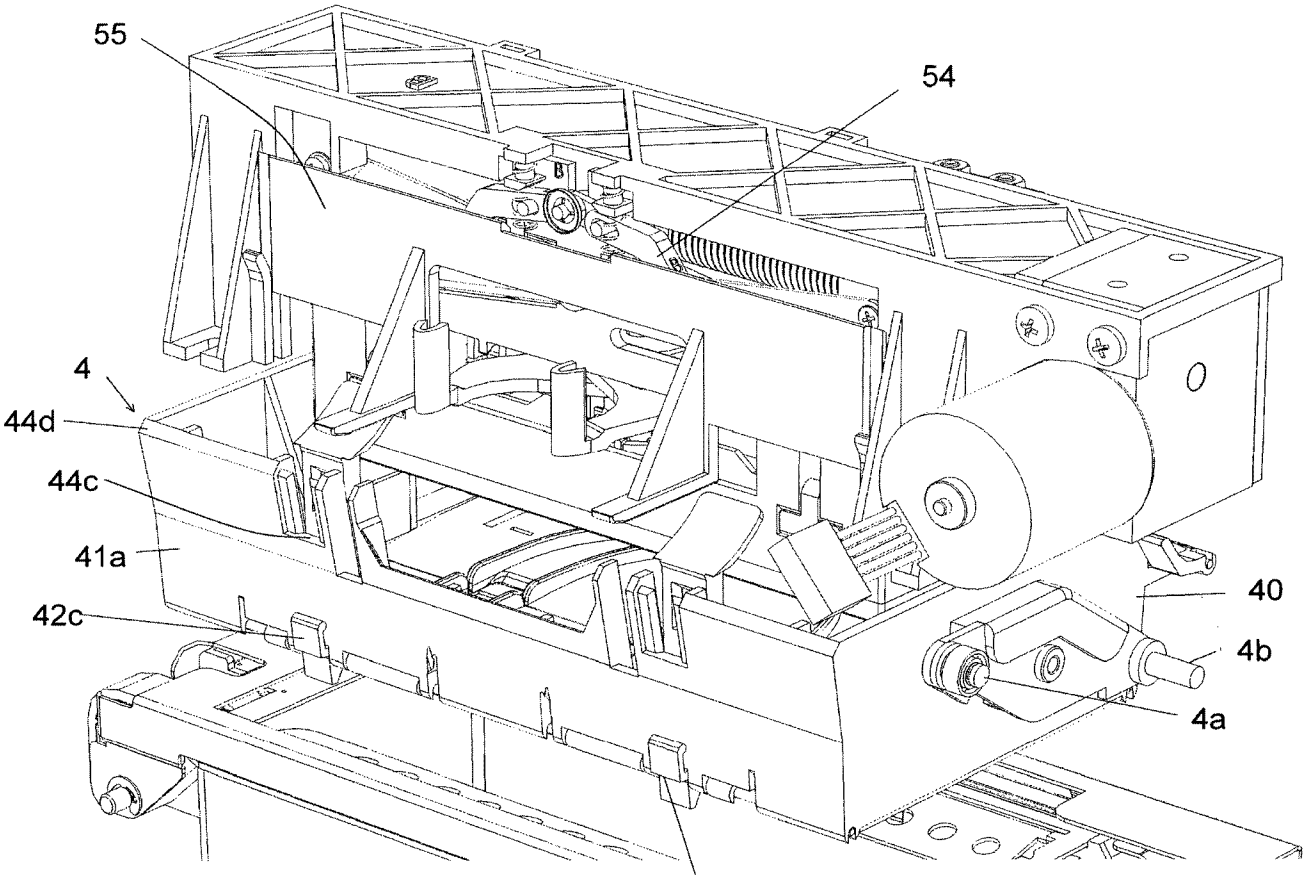
Figure 13:
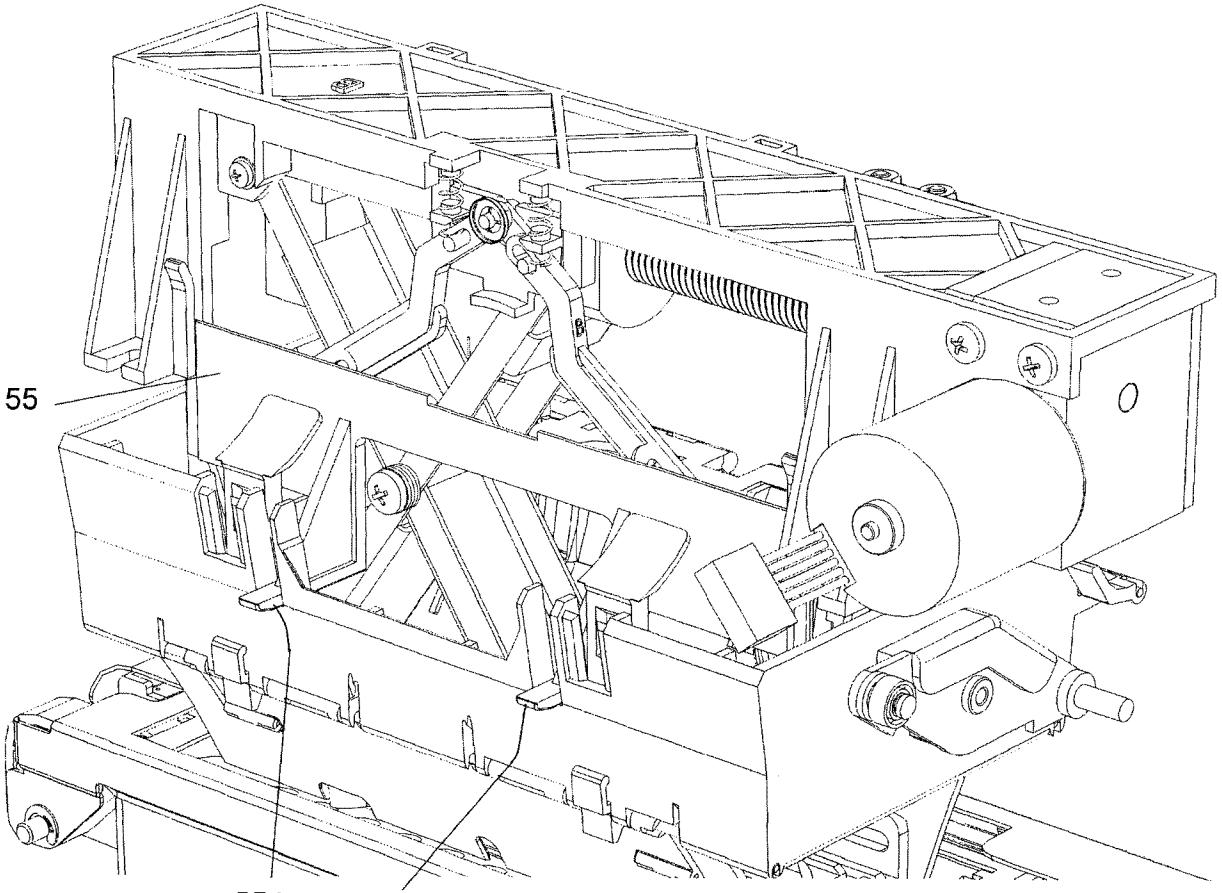
Figure 14:
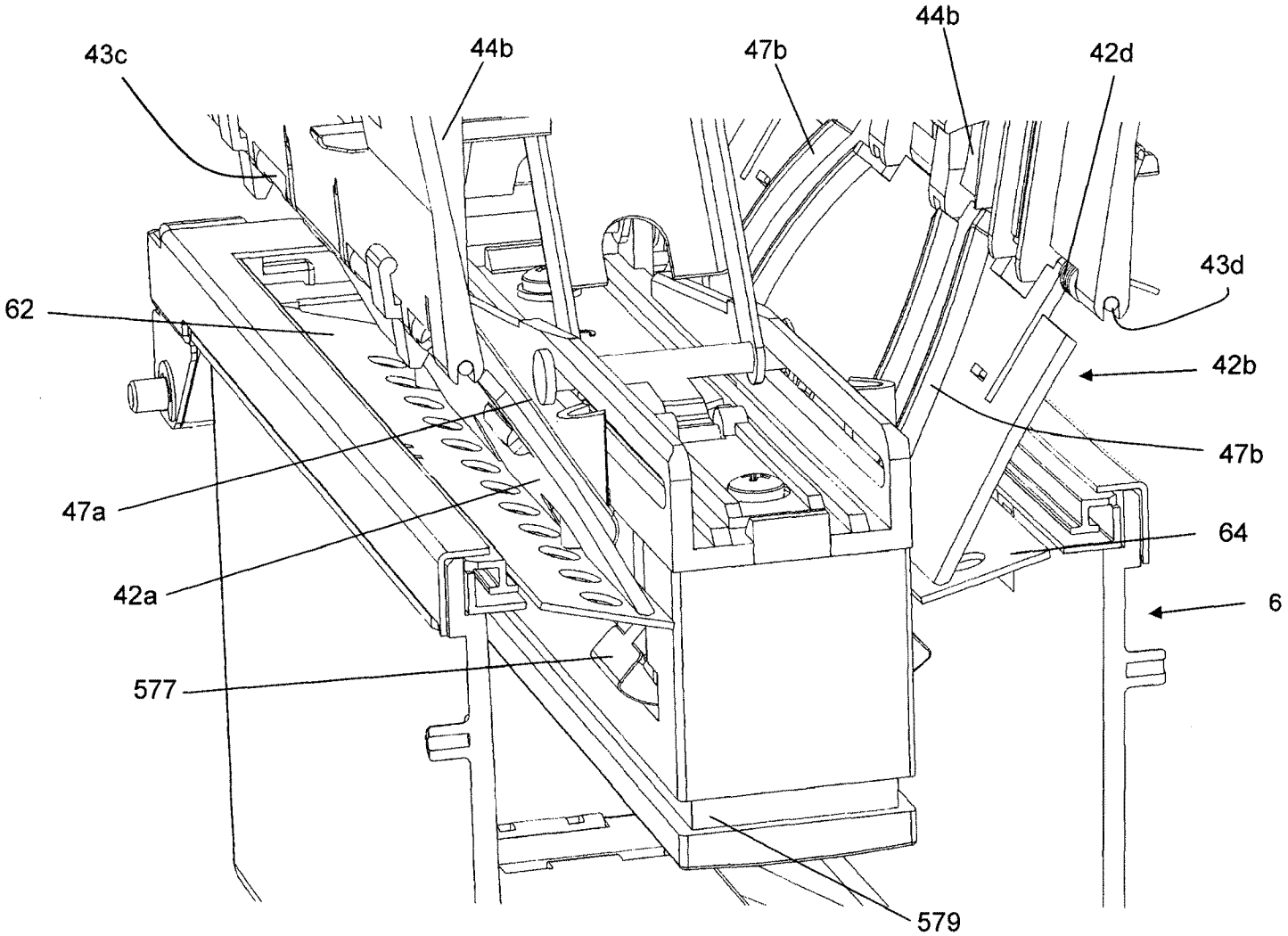
Figure 15:
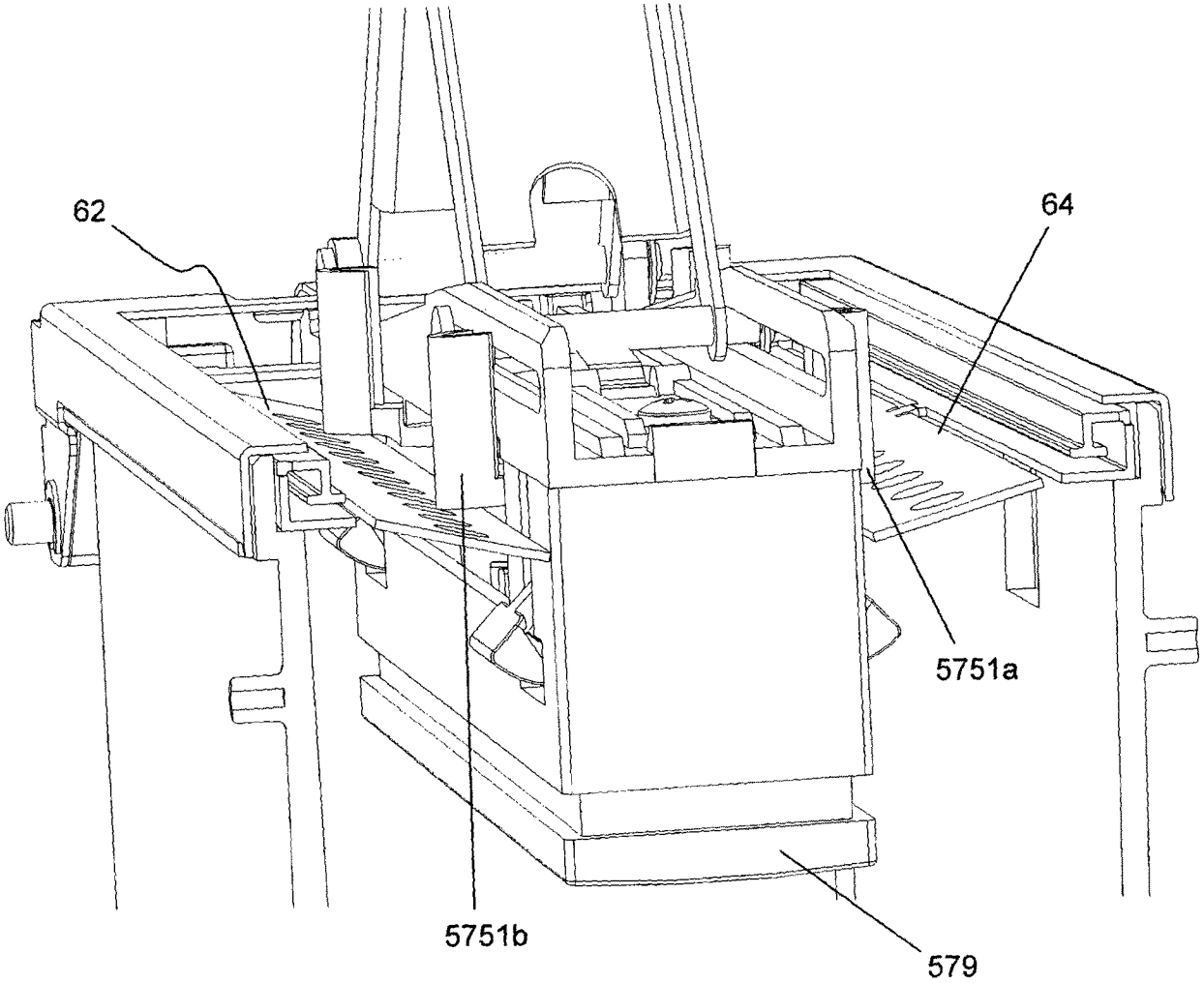

FIGS. 5A and 5B comprise an exploded perspective view of a first part of the plunger;

FIGS. 6A and 6B comprise an exploded perspective view of a second part of the plunger;

FIG. 7 is a view from the obverse side of the plunger as it is shown in the arrangement of FIG. 4D;

FIG. 8 is a perspective view of a wiper assembly forming part of the present invention;

FIG. 9 is an exploded perspective view of the wiper assembly as shown in FIG. 8;

FIG. 10 shows a side sectional view of the foot shown in FIGS. 4A to 4D;

FIG. 11 shows a side sectional view of the foot shown in FIGS. 4E and 4F;

FIG. 12 shows a perspective view of an apparatus for use in the present invention in the first position;

FIG. 13 shows a perspective view of the apparatus of FIG. 12 shown in the second position;

FIG. 14 shows a perspective view of the apparatus of FIGS. 12 and 13 shown in the sixth position; and FIG. 15 shows a further perspective view of the apparatus of FIG. 14 in the sixth position.

Referring first to FIGS. 1 to 3C, there is shown an apparatus 1 for handling currency which includes a housing 2, a counter 3, a movable container 4, a plunger 5 and a securable container 6. The securable container 6 in this embodiment incorporates a tamper evident enclosure for the storage and transport of bank notes similar to that which is disclosed in WO 02/19289 and/or WO 2008/114038, the entire contents of which are incorporated herein by reference.

The housing 2 is generally rectangular in plan having a top 21 and bottom 21', a front wall 23 a rear wall 23' and side walls 27, 27'. A first access door 20 is provided in the top 21 thereof, a second access door 22 is provided in, or forms at least a part of, the front wall 23 thereof and a third access door 27*a* is provided in one of the side walls 27, 27'. The top 21 includes an acceptance push button 21*a* and an rejection push button 21*b* for selectively releasing the counted currency. The first access door 20 is transparent and extends across a portion of the top 21 with a flat portion 20*a*, which is substantially aligned with the top 21, and a ramp portion 20*b*, which extends downwardly from the flat portion 20*a* towards the rear wall 23 of the housing 2. The ramp portion 20*b* includes an uppermost edge 20*c*, a lowermost edge 20*d* and a central depression 20*e* extending from the uppermost edge 20*c* toward the lowermost edge 20*d*. The second access door 22 forms the end wall 23 of the housing 2 and includes a key lock mechanism 22*a* for releasably locking the second access door 22 in a closed position.

Figure 1:
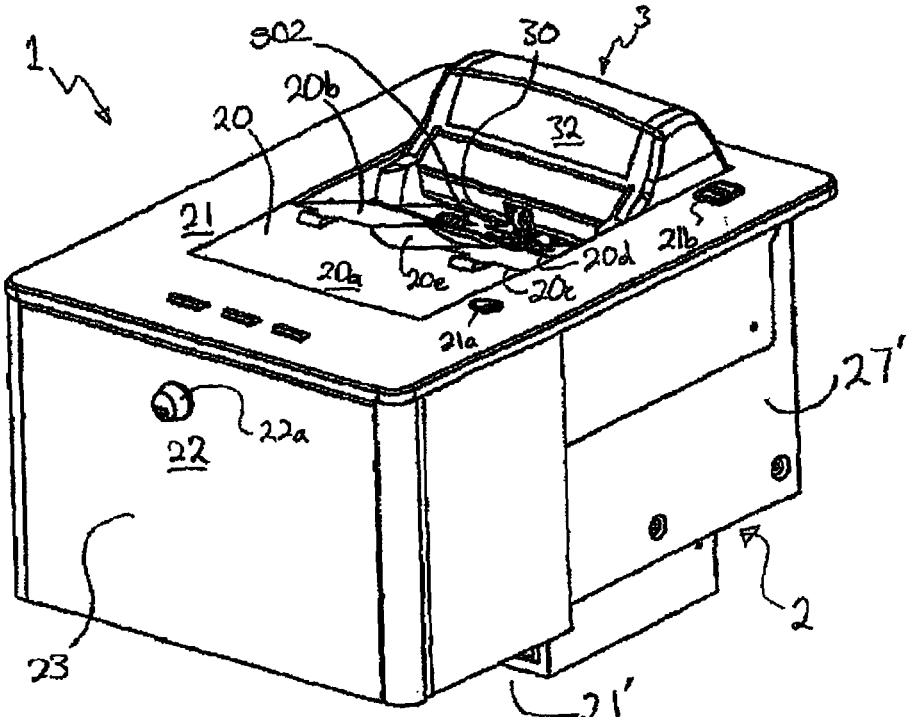
FIG. 1 is a perspective view of an apparatus for use with the present invention.
Figure 2:
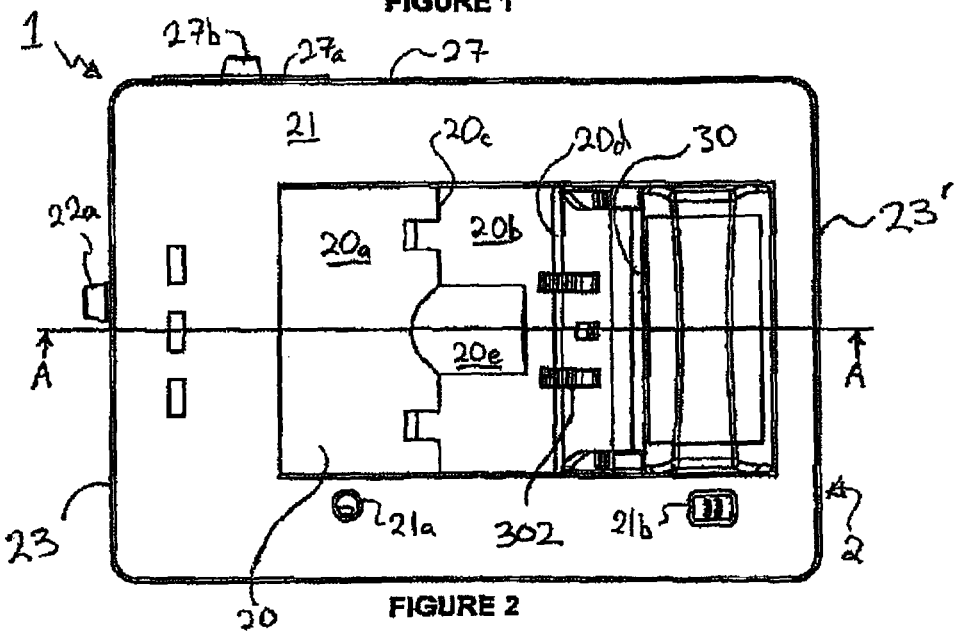
FIG. 2 is a top view of the apparatus of FIG. 1.
Figure 2A:
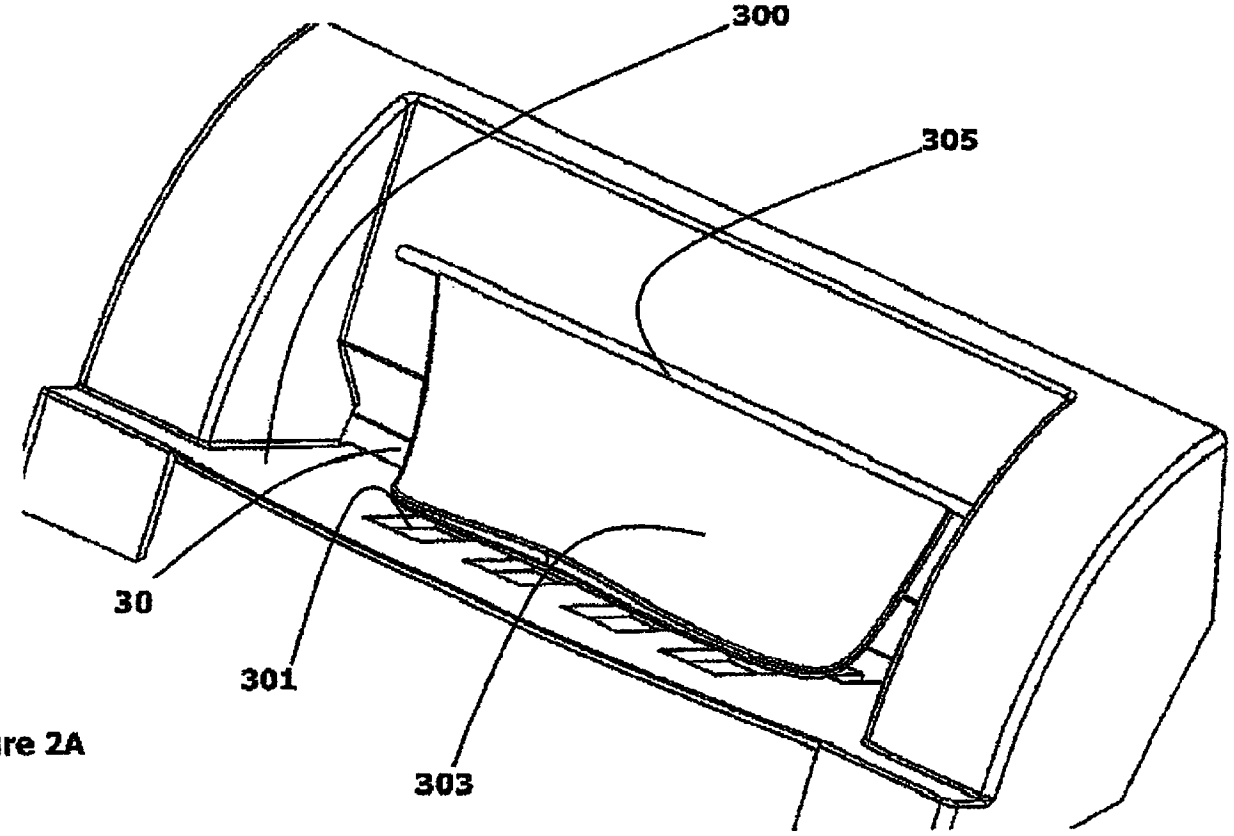
FIG. 2A is a perspective view of an apparatus inlet.

FIG. 2A shows a possible document inlet configuration having a document tray 300 for receiving documents, the tray having a plurality of apertures 301 through which friction wheels 302 protrude to engage documents held in the tray 300 and force them into an inlet 30. There is further provided a pivotable weight 303 comprising a curved weighted body 304 pivotably mounted 305 to the apparatus. In use, the weight 303 is lifted to allow one of more documents to be placed on the tray 300 and the weight lowered on to the top most document in the stack. The weight 303 ensures that the documents are engaged by the friction wheels 302 to encourage proper feeding of documents to the inlet 30. The underside of the weight 303 is smooth so as to flatten crumpled or creased documents as they are drawn passed the leading edge of the weight 303 by the wheels 302.

Figure 3A:
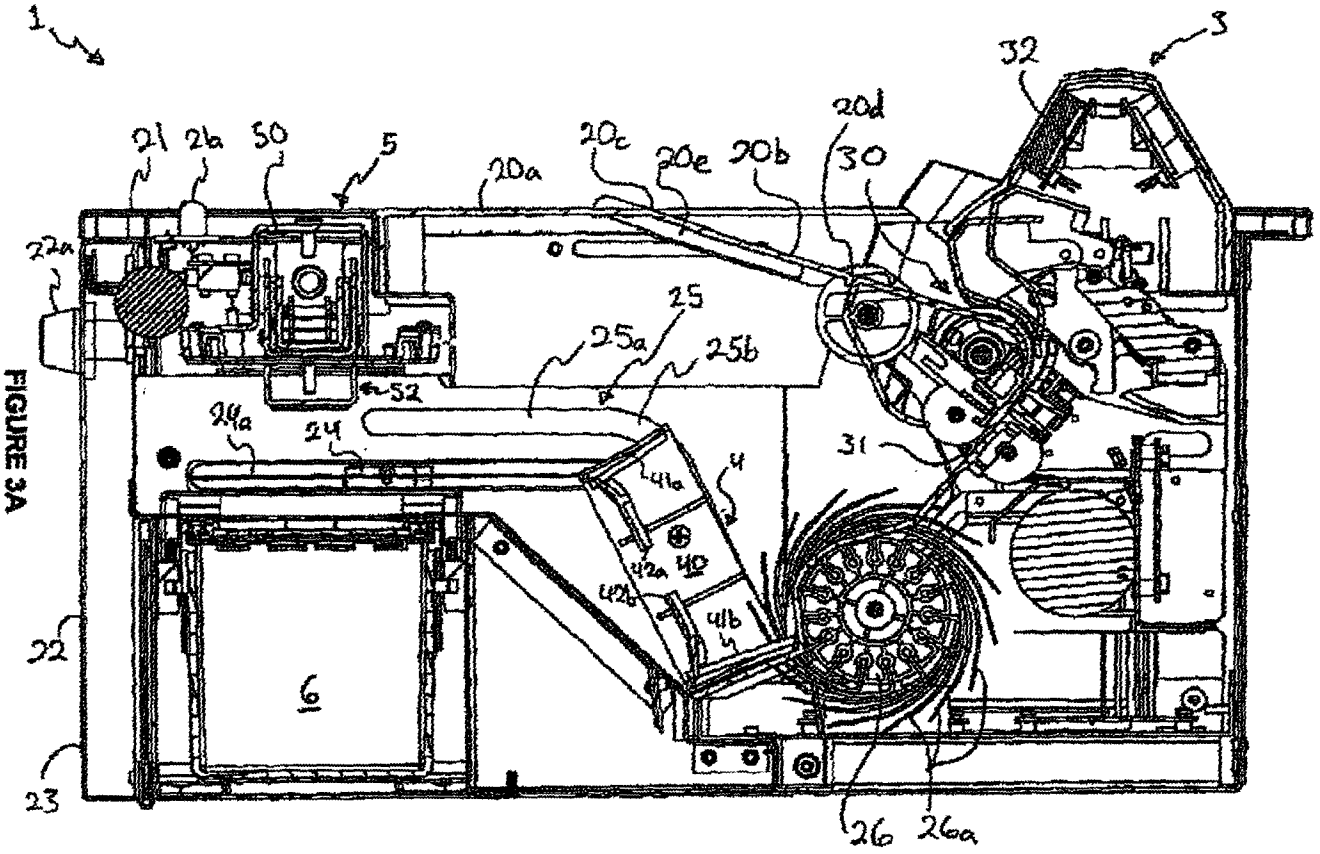
FIG. 3A is a section view along line A-A of FIG. 2 showing the movable container in a first, document receiving position.
Figure 3B:
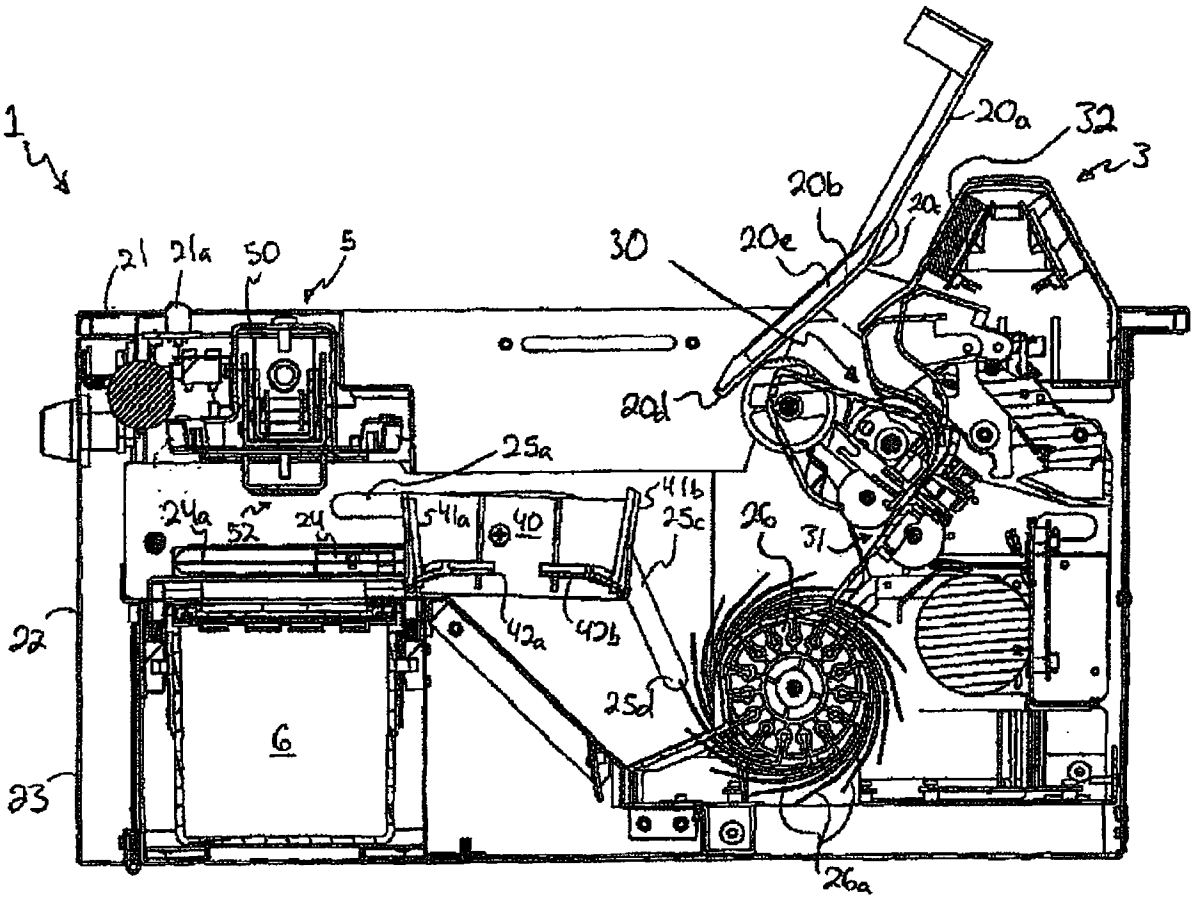
FIG. 3B is a section view along line A-A of FIG. 2 showing the movable container in a second, intermediate or escrow position with the first access door in an open condition.
Figure 3C:
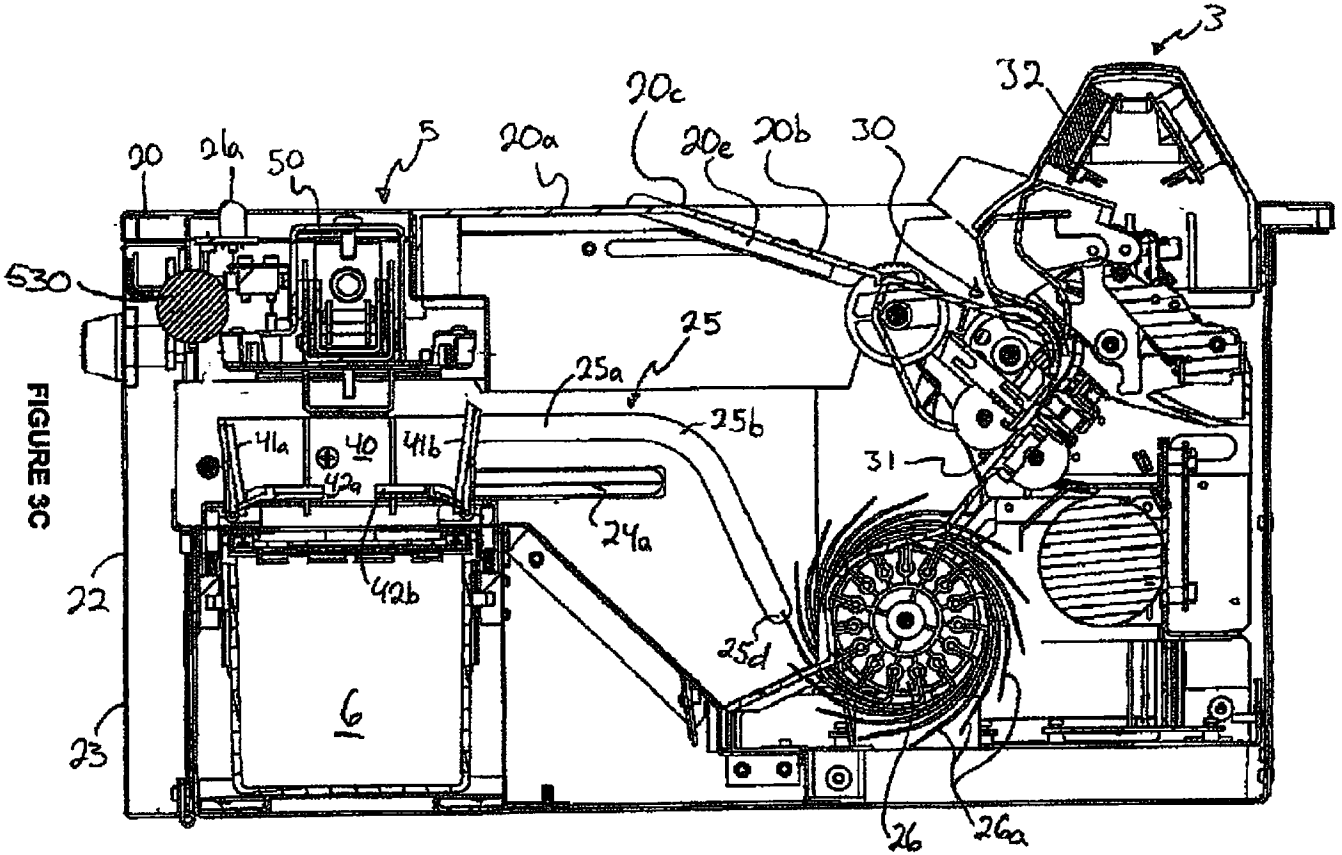
FIG. 3C is a section view along line A-A of FIG. 2 showing the movable container in a third, deposit or drop position.

Referring to FIGS. 3A, B and C, located within the housing 2 is a conveyor 24 and guide slot 25. The conveyor 24 includes a cable 24*a*, or other reciprocable drive means, to which is attached a conveyor carrier (not shown) and a motor (not shown) which drives the cable 24*a*. The guide slot 25 includes first and second straight portions 25*a* and 25*c* interconnected by a curved portion 25*b*. The first straight portion 25*a* is located above and is parallel to the conveyor 24 and the second straight portion 25*c* extends downwardly and at an angle thereto to an end stop 25*d*.

The third access door 27*a* includes a key lock mechanism 27*b* for releasably locking the third access door 27 in a closed position.

The counter 3 is a cash counter in this embodiment which includes the inlet 30, an outlet 31 and a display screen 32 which protrudes upwardly from the top 21 of the housing 2. The counter 3 is mounted to the housing 2 such that the inlet 30 of the counter 3 is located adjacent the lowermost edge 20*d* of the ramp portion 20*b* to facilitate document loading into the counter 3. The outlet 31 of the counter 3 faces the inside of the housing 2 and feeds into a transfer wheel 26 having a pair of arrays of a plurality of finger members 26*a* which extend radially therefrom and are bent to provide a distal tangential portion. Currency fed through the counter 3 exits through the outlet 31 into gaps between adjacent finger members 26*a* on the transfer wheel 26.

The movable container 4 is substantially rectangular in plan with end walls 40, upwardly diverging side walls 41*a*, 41*b* and base flaps 42*a*, 42*b*. Each side wall 41*a*, 41*b* includes a lowermost edge and pair of vertically extending guide channels 44*a*, 44*b* formed by opposed ridges on an internal surface thereof. One or both, of the side walls includes a pair of recesses 44*c* in its uppermost edge 44*d* which are aligned with the guide channels 44*b*. Each base flap 42*a*, 42*b* is connected to the lowermost edge 43*a*, 43*b* of one of the side walls 41*a*, 41*b* by a respective hinge 43*c*, 43*d* and includes a pair of curved guide channels 47*a*, 47*b* formed by opposed ridges on an internal surface thereof. The base flap channels 47*a*, 47*b* are aligned with the side wall guide channels 44*a*, 44*b* adjacent the hinge 43*c*, 43*d* and diverge toward the free edge of the base flap 42*a*, 42*b*. The base flaps 42*a*, 42*b* are biased by a spring mechanism 42*c*, 42*d* to a closed position where they are substantially horizontal and extend inwardly of the movable container 4.

The movable container 4 is mounted within the housing 2 such that its end walls 40 are connected adjacent the front side wall 41*a* by a connector pin 4*a* to the conveyor carrier and a guide member 4*b* is received within the guide slot 25. Thus, the movable container 4 is movable between a loading position (shown in FIG. 3A), an intermediate or escrow position (shown in FIG. 3B) and a deposit or drop position (shown in FIG. 3C).

In the loading position, the guide member 4*b* abuts the end stop 25*d* of the guide slot 25, the movable container 4 has been carried by the conveyor 24 to the rearmost point of its travel and the movable container 4 is inclined so that the recesses 44*c* in the uppermost edge 44*d* of the side wall 41*b* are able to communicate with the finger members 26*a* of the transfer wheel 26.

In the intermediate or escrow position, the guide member 4*b* is within the curved portion 25*b* of the guide slot 25, the conveyor 24 has carried the movable container 4 to an intermediate position and the movable container 4 is substantially horizontal and located beneath the transparent first access door 20.

In the escrow position, the movable container 4 may be engaged by a mechanism (not shown) to lift it through the door 20. Such mechanism may incorporate a scissor lift, actuator or other electrically, hydraulically, pneumatically actuated lift device. Alternatively, the mechanism may engage with the flaps 42*a*, 42*b* of the container 4 to move them out of the way and then lift the documents clear of the housing or access by the customer.

In the drop position, the guide member 4*b* is at the front end of the first straight portion 25*a* of the guide slot 25, the conveyor 24 has carried the movable container 4 to the fully forward position and the movable container 4 is substantially horizontal and located between the plunger 5 and the securable container 6.

The plunger 5 is best shown in FIGS. 4A to 4F and also in FIG. 7. Detailed views of the individual component parts of the plunger 5 are shown in FIGS. 5 and 6.

Referring in particular to FIG. 4D it can be seen that the plunger 5 includes a mounting member 50, an actuator mechanism 53, a first scissor mechanism 54, a pre-compression member 55, a second scissor mechanism 56 and a foot 57.

FIGS. 5A to 5C show a detailed exploded view of the mounting member 50, the actuator mechanism 53, the first scissor mechanism 54, the pre-compression member 55 and the second scissor mechanism 56. FIGS. 6A and 6B shows a detailed exploded view of the foot 57.

Referring first to FIG. 5A the mounting member 50 comprises a frame 501 having a pair of opposed longitudinal side walls 501*a*, 501*b* which are connected at each respective end by first 501*c* and second 501*d* end walls.

The mounting member 50 further comprises four legs 502-505 depending therefrom. Each leg 502-505 is substantially identical to the other and therefore only one (leg 504) shall be described in detail. Leg 504 comprises a base wall 504*a* which depends from the frame 501 and terminates in a foot portion 504*d*. The foot portion 504*d* extends outwardly from the base wall 504*a* at an angle of approximately 90° thereto. A pair of opposing strut walls 504*b* and 504*c* support the foot portion 504*d* with respect to the base wall 504*a*. The foot portion 504*d* may comprise an open-sided slot as indicated by reference numeral 504*e*. It is to be appreciated that the other legs comprise corresponding features to those of leg 504 and that those features are assigned corresponding reference numerals in the drawings. For instance, leg 502 comprises a foot portion indicated by reference numeral 502*d* and so on.

Legs 503 and 504 each comprise a respective limb 506*a*, 506*b*. Limb 506*a* is connected to the outward side of strut wall 503*c* and limb 506*b* is connected to the outward side of strut wall 504*b*.

Each limb 506*a*, 506*b* upstands from about the level of the respective foot portion 503*d*, 504*d* and terminates in an outwardly curved portion. Accordingly, a channel 507*a*, 507*b* is formed between the base wall 503*a*, 504*a* and respective limb 506*a*, 506*b*. The channels 507*a* and 507*b* are open-ended and function to provide a guide for the pre-compression member 55 when the apparatus 1 is in use.

A pair of rebates 508 are also provided within the frame 501. The rebates 508 are opposite from one another and are located adjacent to legs 502, 503.

Frame 501 also comprises a tongue 513 depending from a central region of the longitudinal side wall 501*a*. A spigot 514 extends outwardly from the surface of the tongue 513 in a direction substantially orthogonal thereto. On each side of the spigot 514 the frame 501 also comprises a spring mount 515*a*, 515*b*. The spring mounts 515*a*, 515*b* depend from the longitudinal side wall 501*a* and are for receiving respective springs 521, 522.

A coupling member 516 is coupled to the mounting member 50 via the springs 521 and 522. The coupling member 516 comprises a substantially planar body having a pair of platforms 516*a*, 516*b* extending orthogonally therefrom. Upstanding from each platform 516*a*, 516*b* is a respective spring mount 516*c*, 516*d* for receiving the other end of the spring 521, 522.

In use, spring 521 is received at one end by spring mount 515*a* and at the other end by spring mount 516*c*. Similarly, spring 522 is received at one end by spring mount 515*b* and at the other end by spring mount 516*d*. The coupling member 516 further comprises a pair of spigots 516*e*, 516*f*.

The spigots 516*e*, 516*f* extend from beneath and substantially parallel to respective platforms 516*a*, 516*b*. The coupling member 516 also comprises a depending foot portion 516*g* and, preferably, an open-sided slot 516*h*, the open-sided slot 516*h* for receiving spigot 514 in use. The depending foot portion extends laterally of the coupling member and conveniently includes a curved surface on its lower side.

Referring now to FIG. 7 the frame 501 further comprises on its obverse side, a connector 517 which is clamped thereto by means of nuts 517*a*, bolts 517*b* and intermediate washers 517*c*. The connector 517 comprises a rebate 518.

Referring back to FIG. 5A, the actuator mechanism 53 comprises a support 531, a longitudinal drive shaft 532 extending from the support 531, an actuating block 533 and a drive motor 534. The drive motor 534 is preferably electronically driven.

The support 531 comprises a substantially cuboid geometry having six major faces 531*a*-531*f*. For simplicity, major faces 531*a*-531*d* may be termed side faces and major faces 531*e* and 531*f* may be termed end faces.

In the embodiment shown in the drawings the longitudinal drive shaft 532 extends from side face 531*d* and the drive motor 534 is mounted to side face 531*b*. However, it is clear that other arrangements may be envisaged without departing from the scope of the invention.

The longitudinal drive shaft 532 is partially threaded from the end adjacent to side face 531*d* to approximately three fifths of the way along. The remainder (i.e. approximately two fifths) of the longitudinal drive shaft 532 comprises a relatively smooth outer surface. The terminal end of the longitudinal drive shaft 532 comprises a pin 532*a*.

The actuating block 533 comprises first 533*a* and second 533*b* side faces and a peripheral face 533*c*. Extending through the actuating block 533 from the first side face 533*a* to the second side face 533*b* is a bore having an internal thread which complements the outer thread of the longitudinal drive shaft 532.

As best seen in FIGS. 5A and 7, the actuator mechanism 53 further comprises a component 536 extending from the circumferential face 533*c* of the actuating block 533. The component 536 comprises a central portion 536*a* having a pair of opposed wall portions 536*b*, 536*c* at each end. The component 536 further comprises a lip which extends between the opposed wall portions 536*b*, 536*c*. The component 536 also comprises a tongue 536*e* which extends from the opposite side of the central portion 536*a* to that of the lip.

In the embodiment shown in the drawings the component 536 is connectable to the actuating block 533 by inserting the lip 536*d* into a correspondingly shaped rebate 533*d*. The rebate 533*d* extends between the first side face 533*a* and the second side face 533*b* of the actuating block 533. However, in other embodiments the actuating block 533 and component 536 may be connectable by other means such as by use of rivets or adhesive and so on. Alternatively, the actuating block 533 and component 536 may be integral, such as formed from a single piece of material.

The first scissor mechanism 54 comprises first 541 and second 542 arms pivotable at one end thereof about respective apertures 543*a*, 543*b*. Adjacent to the apertures 543*a*, 543*b* each arm 541, 542 comprises a first slot 544*a*, 544*b*. At the other end each arm 541, 542 comprises a second slot 545*a*, 545*b*. In each arm 541, 542 the second slot 545*a*, 545*b* is longer than the first slot 544*a*, 544*b*.

The pre-compression member 55 comprises a substantially planar plate 551 having pair of longitudinal edges 551*a*, 551*b* and a pair of side edges 551*c*, 551*d*. Along each side edge 551*c*, 551*d* the plate 551 comprises a thinned portion 552*a*, 552*b* or bevelled edge. Each thinned portion 552*a*, 552*b* extends from one longitudinal edge 551*a* to the other longitudinal edge 551*b*. The pre-compression member 55 further comprises a pair of legs 553*a*, 553*b* having corresponding feet 554*a*, 554*b* extending orthogonally therefrom. The underside of each foot 554*a*, 554*b* provides a compression surface. The pre-compression member 55 preferably comprises struts 555*a*, 555*b* which are present to provide support and to ensure that the feet 554*a*, 554*b* remain sturdy, for example so that the feet 554*a*, 554*b* do not skew with respect to the legs 553*a*, 553*b* when the apparatus 1 is being used.

The second scissor mechanism 56 comprises first 561 and second 562 scissor pairs, each pair 561, 562 having first 561*a*, 562*a* and second 561*b*, 562*b* arms.

The arms 561*a*, 561*b* of the first scissor pair 561 are in use pivotable about a bolt 566*a* extending through an aperture 561*c*. The aperture 561*c* extends through both of the arms 561*a*, 561*b* at a central region thereof. The arms 562*a*, 562*b* of the second scissor pair 562 are in use also pilotable about the bolt 566*a* extending through a central aperture 562*c*. Further apertures *a*-*h* are provided at the ends of each of the arms 561*a*, 561*b*, 562*a*, 562*b* for mounting the second scissor mechanism 56 to the other components of the plunger 5 (as will become apparent further below).

The first 561 and second 562 scissor pairs are positioned side by side and are connected to one another by first 563*a*, second 563*b* and third 563*c* bridging members. There is a gap 569 between the first and second bridging members 563*a*, 563*b* to allow the scissor pairs 561, 562 to open and close without hindrance about the central apertures 561*c*, 562*c*. The first 561 and second 562 scissor pairs are also connected at their central apertures 561*c*, 562*c* via the bolt 566*a* and nut 566*b* and associated washers 566*c*. The washers 566*c* form a surface for abutment with the foot 516*g* of the coupling member 516 as will be described.

Referring now to FIGS. 6A and 6B, it can be seen that the foot 57 comprises a body 571, a connecting member 573, a wiper assembly 575, levers 577 and a base 579.

The body 571 comprises an underside 5711 having a pair of opposed longitudinal side walls 5711*a*, 5711*b* and a pair of opposed end walls 5711*c*, 5711*d* upstanding therefrom. Each end wall 5711*c*, 5711*d* comprises a respective locking member 5712*a*, 5712*b*.

Longitudinal side wall 5711*a* comprises a pair of channels 5713*a*, 5713*b*, each channel 5713*a*, 5713*b* extending from a respective window 5714*a*, 5714*b* and terminating in an upper edge of the wall 5711*a*. Longitudinal side wall 5711*b* comprises identical channels 5713*c*, 5713*d* and windows 5714*c*, 5714*d*.

Located inside the body 571 and on each side of the channel 5713*c* are inner wall portions 5715*a* and 5715*b*. The inner wall portions 5715*a*,5715*b* extend from the surface of the side wall 5711*b*. A further inner wall portion 5715*c* is also provided adjacent to inner wall portion 5715*b*. Each inner wall portion 5715*a*-*c* comprises an aperture 5716 extending therethrough, each of the apertures 5716 being located at or around the same height. For the avoidance of doubt, the remaining channels also comprise inner walls portions 5715*a*-*c* and apertures 5716.

The body 571 further comprises a seating 5717 and opposed spring guides 5718*a*, 5718*b* for receiving a spring 5719. Spring 5719 is a coil spring having a diameter which is wider at one end than at the other. In the embodiment shown in the drawings, the diameter of the spring 5719 decreases linearly from one end to the other.

The connecting member 573 comprises a base portion 5731 having a pair of opposed longitudinal side walls 5731*a*, 5731*b* and a pair of ends 5731*c*, 5731*d*. Extending from end 5731*d* the longitudinal side walls 5731*a*, 5731*b* have a constant height along a first portion in which the walls 5731*a*, 5731*b* comprise respective channels 5735*a*, 5735*b*. Extending further from end 5731*d* the height of the side walls tapers until the side walls terminate. In the embodiment shown in the drawings, the side walls 5731*a*, 5731*b* terminate before reaching end 5731*c*.

Each end 5731*c*, 5731*d* comprises a respective rebate 5732*a*, 5732*b* for receiving locking members 5712*a*, 5712*b* of the body 571. The locking members 5712*a*, 5712*b* and rebates 5732*a*, 5732*b* co-operate in the form of a snap-fit type mechanism.

The connecting member 573 further comprises a pair of opposed upstanding portions 5733*a*, 5733*b* which are located adjacent to end 5732*a*. Each upstanding portion 5733*a*, 5733*b* comprises a respective aperture 5734*a*, 5734*b*.

Located between the side walls 5731*a*, 5731*b* there comprises a lever 5739. The lever 5739 is rotatable about a pin 5739*a* which spans between the side walls 5731*a*, 5731*b*. The lever 5739 comprises a flat upper face 5739*b* which extends from about the region of the pin towards an apex 5739*c*. Between the apex 5739*c* and the terminal portion the lever 5739 is a shallow recess 5739*d*.

The wiper assembly 575 comprises first 5751 and second 5752 arms pivotable about a central axis in the form of a scissor pair. Referring now to FIGS. 8 and 9 it can be seen that each arm 5751, 5752 of the wiper assembly 575 further comprises a pair of contact members 5751*a*, 5751*b*; 5752*a*, 5752*b*. The contact members 5751*a*, 5751*b* of the first arm 5751 comprise portions upstanding from the ends thereof. Similarly, the contact members 5752*a*, 5752*b* of the second arm 5752 comprise portions upstanding from the ends thereof. The first arm 5751 also comprises an aperture 5753 located in a central region thereof. The central region includes a recessed region 5755 and first and second arcuate openings 5757 to either side of the recess 5755. The second arm 5752 includes within a central region a boss 5754 and a collar 5756, each extending out of the plane of the second arm in a direction opposite to the contact members. Further first and second arcuate openings 5758 are provided about the central region.

In use, the aperture 5753 receives the boss 5754 which depends from the underside of the second arm 5752, the collar 5756 of the second arm being received within the recess 5755 of the first arm. A biasing member in the form of a spring 5755 is provided between the first 5751 and second 5752 arms. The spring 5755 is connected at first end a to mounting means located around the boss 5754 and the collar 5756 and at a second end b is connected to mounting means in the recess 5755 of the first arm. Thus, the arms 5751, 5752 are resiliently biased towards a predetermined relationship and will resist movement away from this position. The wiper assembly 575 is located over the spring guides 5718*a*, 5718*b* by locating the spring guides 5718*a*, 5718*b* through the respective arcuate openings 5757, 5758 of the first and second arms.

The headed pin 5738 passes through the central apertures of the first and second arms, the first and second arms being adapted to scissor or pivot about the shaft of the headed pin 5738.

Referring now back to FIG. 6 it can be seen that the foot 57 has four levers 577, each lever 577 comprising a body 5771 and a contact face 5772. The levers 577 also comprise an extended portion 5774 extending from the side opposite to the contact face 5772. Further, each lever 577 comprises a through-bore 5773 interposed between the body 5771 and the extended portion 5774.

The foot 57 also comprises a base 579 having a substantially planar body 5791. The substantially planar body comprises first 5791*a* and second 5791*b* portions. The periphery of the first portion 5791*a* is greater than the periphery of the second portion 5791*b* such that a lip 5791*c* is provided around the base 579.

Upstanding from the second portion 5791*b* the base 579 comprises two hollow cylindrical bodies 5792*a*, 5792*b*. Cylindrical body 5792*a* comprises a bore 5793*a* extending therethrough. The cylindrical body 5792*a* also comprises a pair of diametrically opposed shoulders 5794*a*, 5794*b* located towards the upmost end thereof. Similarly, cylindrical body 5792*b* comprises a bore 5793*b* extending therethrough. The cylindrical body 5792*b* also comprises a pair of diametrically opposed shoulders 5794*c*, 5794*d* located towards the upmost end thereof. The base 579 further comprises a cavity 5795 which is located at around the centre of the second portion 5791*b*.

The way in which the component parts of the plunger 5 are interconnected will now be described with reference to FIGS. 5 to 7.

The longitudinal drive shaft 532 of the actuator mechanism 53 is supported by the mounting member 50. The pin 532*a* of the drive shaft 532 slots into a collar 535 which itself slots into an aperture 512 located in the side wall 501*c* of the mounting member 50. At the other end, the support 531 is held by the frame 50 via screws 510*a*, 511*a* which extend through apertures 510, 511 and into corresponding screw holes 5310. As will be appreciated, the underside of the frame 501 towards end wall 501*d* is shaped so as to receive the support 531 and drive motor 534. For instance, in the embodiment shown in the drawings there is a region between the end 501*d* of the frame 501 and the legs 504, 505 which comprises a shape curved so as to receive the cylindrical body of the drive motor 534.

The arms 541, 542 of the first scissor mechanism 54 are mounted onto the spigot 514 of the tongue 513 via apertures 543*a*, 543*b*. The arms 541, 542 are held in place by a snap ring 546. In addition, the spigot 516*e* extends through the slot 544*a*. Similarly, the spigot 516*f* extends through the slot 544*b*. The other ends of the arms 541, 542 are connected to the pre-compression member 55. As can be seen in FIG. 7 the inside face of the substantially planar plate 551 comprises a pair of spigots 558*a*, 558*b* extending therefrom. The spigot 558*a* extends through the slot 545*b* and the spigot 558*b* extends through the slot 545*a*. The arms 541, 542 are held in place via snap rings 557*a*, 557*b* which are secured to the respective spigots 558*b*, 558*a*.

The first 561 and second 562 scissor pairs of the second scissor mechanism 56 are connected at their upper ends to the mounting member 50 and the longitudinal drive shaft 53. The arms 561*a* and 562*a* are connected to the actuating block 533 at their respective ends via grub screws 564*c* and 564*d*. The grub screws 564*c*, 564*d* extend through respective apertures *b, f* and into internally threaded bores 533*e* located on the peripheral face 533*c* of the actuating block 533 at opposite sides thereof. The other arms 561*b* and 562*b* are connected to the mounting member 50 at their respective ends via grub screws 564*a* and 564*b*. The grubs screws 564*a*, 564*b* extend through respective apertures *c, g* and into internally threaded bores 508*a* located in the frame 501 at the region of the rebates 508.

The first 561 and second 562 scissor pairs are connected at their lower ends to the foot 57. In particular, the arms 561*a*, 562*a* are connected to respective upstanding portions 5733*b*, 5733*a* of the connecting member 573 via a headed pin 567*a*. The headed pin 567*a* extends through apertures *a, e*, 5734*a*, 5734*b* and is secured in place by a circlip 568*a*. Similarly, the arms 561*b*, 562*b* are connected to respective walls 5731*b*, 5731*a* of the connecting member 573 via headed pin 567*b*. The headed pin 567*b* extends through apertures *d, h* and channels 5735*a*, 5735*b* and is secured in place by a circlip 568*b*.

Turning specifically now to FIG. 6 the wiper assembly 575 engages the connecting member 573 via a headed pin 5738. The headed pin 5738 extends through the aperture 5753 and collar 5754 of the wiper assembly 575 to bring the two arms 5751, 5752 into contact with the underside of the connecting member 573. The headed pin 5738 comprises a contact face 5738*a* at a lowermost end thereof. The uppermost end of the headed pin 5738 contacts the lever 5739 at a region beneath the shallow recess 5739*c*.

The body 571 and the connecting member 573 are releasably engageable via the locking members 5712*a*, 5712*b* and rebates 5732*a*, 5732*b* which operate in the form of a snap-fit type mechanism. The spring 5719 is interposed between the connecting member 573 and the wiper assembly 575. The uppermost portion of the spring 5719 abuts a generally circular recess in the underside of the connecting member 573. The lowermost portion of the spring 5719 is seated on an upper surface of the upper arm 5752 of the wiper assembly 575. The spring 5719 provides a passageway for the headed pin 5738 to pass.

Each lever 577 is held in place via pins 5720*a-d*. For instance, the pin 5720*c* extends through the apertures 5716 of the inner wall portions 5715*a-c* and the through-bore 5773 of the lever 577 to position the body 5771 of the lever 577 within the window 5714*d* of the longitudinal side wall 5711*b*.

The base 579 of the foot 57 is connected to the underside 5711 of the body 571. A first threaded bolt 5736*a* extends through an aperture in the connecting member 573 and into the internal cavity defined by the body 571. The first threaded bolt 5736*a* further extends into the bore 5793*a* of the first cylindrical body 5792*a* of the base 579. A corresponding first tubular bolt 5796*a* extends through a spring 5797*a* and into the bore 5793*a* of the first cylindrical body 5792*a* from the underside of the base 579. Similarly, a second threaded bolt 5736*b* extends through an aperture and into the internal cavity defined by the body 571. This second threaded bolt 5736*b* further extends into the bore 5793*b* of the second cylindrical body 5792*b*. The second threaded bolt 5738*b* is also used to secured the lever 5739 to the connecting member 573. A corresponding second tubular bolt 5796*b* extends through a spring 5797*b* and into the bore 5793*b* of the second cylindrical body 5792*b* from the underside of the base 579. The first 5796*a* and second 5796*b* tubular bolts comprise an inner thread which corresponds to the outer thread of first 5736*a* and second 5736*b* threaded bolts. Thus, the threaded bolts 5736*a*, 5736*b* and the respective tubular bolts 5796*a*, 5796*b* may be screwed together in order to secure the base 579 to the body 571.

The way in which the plunger 5 operates will now be described with particular reference to FIGS. 4A to 4F and FIGS. 10 to 15.

Referring first to FIGS. 4A and 12, the plunger 5 is shown in a fully retracted arrangement. In this arrangement it will be appreciated that the first scissor mechanism 54 is in a fully retracted position so that the pre-compression member 55 may be held in a stowed (upper) position. The second scissor mechanism 56 is also in a fully contracted position so that the foot 57 is also held in a stowed (upper) position. The contact members 5751*a*, 5751*b*; 5752*a*, 5752*b* of the wiper assembly 575 are also fully contracted.

The plunger 5 is located above the moveable container 4, the moveable container 4 in turn being located above the securable container 6.

In a first phase of operation the longitudinal drive shaft 532 is rotated by the drive motor 534 to cause the actuating block 533 to translate therealong through a second position (it can be seen from comparing FIG. 4A and FIG. 4B that the actuating block 533 moves in a direction towards the left-hand side of the page). This causes the second scissor mechanism 56 to start to be deployed, moving it to a first position. As the second scissor mechanism 56 is connected to the connecting member 573, movement of the second scissor mechanism causes the foot 57 to be lowered to a first lowered position by movement of the headed pin 567*b* along the channels 5735*a*, 5735*b* from the end 5731*d* of the connecting member 573 to the other end 5731*c*.

Movement of the second scissor mechanism also allows movement of the first scissor mechanism. As bolt 566*a* is driven downward, the abutment surface formed by the washers 566*c* moves away from an upper position. The coupling member 516 is biased way from an upper position by the actions of the springs 521, 522 to cause the coupling member 516 to follow this abutment surface. This in turn allows the upper slots 544*a* and 544*b* of the arms 541, 542 to slide over their respective spigots 516*e*, 516*f* on the coupling member 516 and the respective lower slots 545*b*, 545*a* of the arms 541, 542 to slide over the spigots 558*a*, 558*b* of the pre-compression member 55 and causes lowering of the pre-compression member 55. In practice as may be seen by reference to FIG. 13, the feet 544*a*,544*b* of the pre-compression member 55 enter channels formed in the moveable container 4 and become seated at the base of these channels. This has the effect of aligning the currency documents before the plunger pushes the stack of currency documents from the moveable container to prevent folded, bent or otherwise deformed currency documents located at or toward the top of the document stack becoming trapped between the foot 57 of the plunger 50 and the base flaps 42*a*, 42*b* of the securable container 6.

The ends 551*c*, 551*d* of the lowermost edge of the pre-compression member 55 are receivable by the channels 507*a*, 507*b* so that the pre-compression member 55 does not deviate from straight line movement when it is raised or lowered. It is important that the pre-compression member 55 does not deviate from straight line movement to ensure correct travel of the feet within the channels of the moveable container. This is especially true in cases where the pre-compression member 55 experiences resistance in the form of bank notes. If the pre-compression member 55 were to not maintain straight line movement under resistance the efficacy and reliability of the function of the pre-compression member 55 would be significantly reduced, e.g. due to twisting or tilting thereof.

In a second phase of operation the longitudinal drive shaft 532 is further rotated by the drive motor 534 to cause the actuating block 533 to translate therealong through a third position. As will be appreciated from comparing FIG. 4B and FIG. 4C the actuating block 533 has moved further towards the left-hand side of the page. This movement causes the headed pin 567*b* to continue to move along the channels 5735*a*, 5735*b* from the end 5731*d* of the connecting member 573 to the other end 5731*c* and thus results in the foot 57 being lowered from the first lowered position to a second lowered position as shown in FIG. 4C. The abutment surface of the second scissor mechanism moves beyond the action of the springs 521, 522 of the coupling member 516 and the feet 544*a*, 544*b* of the pre-compression member 55 remain biased to the base of the channels in the moveable container, but are not driven further (FIG. 13).

In a third phase of operation the longitudinal drive shaft 532 is further rotated by the drive motor 534 to cause the actuating block 533 to translate therealong through a fourth position. As will be appreciated from comparing FIG. 4C and FIG. 4D the actuating block 533 has moved even further towards the left-hand side of the page. This movement causes the headed pin 567*b* to continue to move along the channels 5735*a*, 5735*b* from the end 5731*d* of the connecting member 573 to the other end 5731*c* and thus results in the foot 57 being lowered from the second lowered position to a third lowered position as shown in FIG. 4D.

This causes the foot 57 to urge open and push through the base flaps 42*a*, 42*b* of the moveable container. At the same time, the contact members 5751*a*, 5751*b*; 5752*a*, 5752*b* of the wiper assembly are introduced into the side wall guide channels 44*a*, 44*b* and guided by these channels to move outwardly with respect to one another. Following the base flaps 42*a*, 42*b* of the moveable container being moved apart, as the foot 57 descends the contact members 5751*a*, 5751*b*; 5752*a*, 5752*b* of the wiper assembly transition into the guide channels formed in the base flaps 42*a*, 42*b*.

It will be understood that the construction of the wiper assembly, and in particular the collar and boss arrangement, add stability to the scissor action and prevents tilting of the wiper assembly when depositing large numbers of notes, thereby ensuring the reliability of the wiper action and note deposit.

As can be understood from FIG. 7 the tongue 536*e* of component 536 is adapted in the first position to be located within the rebate 518 of connector 517. As the actuating block 533 moves under the action of longitudinal drive shaft 532 the component 536 exits the rebate 518.

In a fourth phase of operation the longitudinal drive shaft 532 is further rotated by the drive motor 534 to cause the actuating block 533 to translate therealong through a fifth position. As will be appreciated from comparing FIG. 4D and FIG. 4E the actuating block 533 has moved even further towards the left-hand side of the page. This movement causes the headed pin 567*b* to continue to move along the channels 5735*a*, 5735*b* from the end 5731*d* of the connecting member 573 to the other end 5731*c* and thus results in the foot 57 being lowered from the third lowered position to a fourth lowered position as shown in FIG. 4E.

This movement pushes the foot beyond the base flaps 42*a*, 42*b* of the moveable container and through flaps 62, 64 on the securable container 6 to push the stack of currency documents into the securable container 6.

The flaps 62, 64 are resiliently biased to prevent such movement. Thus, as the contact members 5751*a*, 5751*b*; 5752*a*, 5752*b* of the wiper assembly reach the end of the channels in the base flaps 42*a*, 42*b* of the moveable container 4, lower surfaces of the contact members 5751*a*, 5751*b*; 5752*a*, 5752*b* of the wiper assembly are caught by and abut the flaps 62, 64 of the securable container 6. The spring 5719 maintains the wiper assembly 575 at a lowest position with respect to the body 571 until the of the contact members 5751*a*, 5751*b*; 5752*a*, 5752*b* of the wiper assembly are caught by and abut the flaps 62, 64 of the securable container 6.

As the plunger continues to descend, the wiper assembly 575 is raised relative to the rest of the foot 57 by the flaps 62, 64 (FIGS. 4E and 11) and the spring 5719 is placed into compression. This has as an advantage that it prevents the flaps 62, 64 from opening excessively (as the wipers do not displace the flaps 62, 64) which may allow currency to escape from the securable container (either as the plunger enters or is withdrawn).

In addition, and as is appreciated best in FIGS. 4E, 11 and 14, movement of the headed pin 567*b* (not shown in FIGS. 10 and 11) over the flat portion 5739*a* of the lever 5739 causes the lever 5739 to gradually press down on headed pin 5738. Simultaneously, the contact face 5738*a* of the headed pin 5738 urges down on the cavity 5795 of the second portion 5791*b* of the base 579 which results in the base 579 protruding from the body 571 as shown in FIG. 4E (and also FIGS. 14 and 15). This second stage plunger action of the foot 57 seeks to release any currency documents caught between the sides of the plunger 5 and the base flaps 42*a*, 42*b* of the securable container.

Further, as the base 579 protrudes from the body 571, the shoulders 5794*a-d* of the cylindrical portions 5792*a*, 5792*b* contact the extended portions 5774 of the levers 577 and cause the levers 577 to rotate about the pins 5720*a-d* so that the contact faces 5772 of the levers 577 protrude from the body 571 as shown in FIG. 4E. It will be understood that rotation of the levers 577 will dislodge any currency that has become caught or otherwise affixed to the side surfaces 5711*a*, 5711*b* of the foot 57.

In a fifth phase of operation the longitudinal drive shaft 532 is further rotated by the drive motor 534 to cause the actuating block 533 to translate therealong to a sixth position. As will be appreciated from comparing FIG. 4E and FIG. 4F the actuating block 533 has moved even further towards the left-hand side of the page. This movement causes the headed pin 567*b* to continue to move along the channels 5735*a*, 5735*b* from the end 5731*d* of the connecting member 573 to the other end 5731*c* and thus results in the foot 57 being lowered from the fourth lowered position to a fifth and fully extended lowered position as shown in FIG. 4F.

In order to withdraw the plunger from the apparatus 1, the drive motor 534 is reversed to cause the actuating block to move from the position in FIG. 4F back to the position in FIG. 4A. The headed pin 567*b* will be moved back along the channels 5735*a*, 5735*b*, first causing the second portion 5791*b* of the base 579 to be retracted into the base 579 and the levers 577 to be reset. Under the action of the spring 5719 the wiper assembly 575 will be returned to its lower position with respect to the body 571. Thereafter, the contact members 5751*a*, 5751*b*; 5752*a*, 5752*b* of the wiper assembly will retrace their paths through the base flaps 42*a*, 42*b* of the moveable container 6, allowing the base flaps 42*a*, 42*b* to close as the plunger is raised and the contact members 5751*a*, 5751*b*; 5752*a*, 5752*b* transition into the side wall guide channels. Finally as the second scissor assembly 56 is raised towards it initial position the abutment surface formed by the washers 566*c* becomes seated against the foot 516*g* of the coupling member 516 causing the first scissor assembly 54 to be raised and the pre-compression member 55 lifted from its seating in the moveable container 6. When the plunger has been fully raised, the moveable container may be returned to the loading position to receive further funds.

The invention claimed is:

1. A plunger for urging in use documents into a securable container, the plunger being moveable between a first retracted position and a second advanced position, wherein the plunger comprises at least a first portion and a second portion, the first and second portions of the plunger being moveable together in a first stage between the first retracted position and an intermediate position, the second portion of the plunger then becoming displaced from the first portion of the plunger at the intermediate position, the second portion of plunger thereafter being moveable in a second stage from the intermediate position to the second advanced position of the plunger characterised in that the plunger further comprises a plurality of displaceable levers located within the first portion of the plunger, retained within the first portion of the plunger during the first stage of movement of the plunger, and adapted to be displaced through a side wall of the first portion of the plunger as the second portion of the plunger is moved to the second advanced position.

2. The plunger according to claim 1, characterised in that at least one of the levers is provided with an operational surface aligned with the side wall of the first portion of the plunger during the first stage of plunger movement and displaced from alignment during the second stage of plunger movement.

3. A plunger for urging in use documents into a securable container, the plunger being moveable between a first retracted position and a second advanced position, wherein the plunger comprises a plurality of displaceable levers moveable between a first position in which an operational surface is aligned with the side surfaces of the plunger and a second position in which the operational surface is displaced from alignment with the side surface of the plunger.

4. The plunger according to claim 3, characterised in that the plunger further comprises a connecting member and a first scissor mechanism, relative movement of the first scissor mechanism and the connecting member causing the operational surface to be displaced.

5. The plunger according to claim 4, the plunger further comprising a first portion and a second portion, the relative movement of the first scissor mechanism and the connecting member causes the first portion of the plunger and the second portion of the plunger to be displaced relative to one another causing the operational surface to be displaced.

6. The plunger according to claim 5, characterised in that the plurality of displaceable levers are located within the first portion of the plunger and the operational surface is aligned with, and displaced from alignment with a side surface of the first portion of the plunger.

7. The plunger according to claim 5, characterised in that the second portion of the plunger is provided with shoulders to contact the plurality of levers to displace the operational surface.

8. A plunger for urging a stack of documents from a movable container into a securable container, the plunger being moveable between a first retracted position and a second advanced position, wherein the plunger further comprises an alignment means, the alignment means adapted to move between a first stowed position and a second deployed position, wherein in the first stowed position a base of the alignment means is displaced vertically a first distance from a base of the plunger and in the second deployed position the base of the alignment means is displaced a second distance from the base of the plunger, the second distance being less than the first distance, and where in the second deployed position at least a part of the base of the alignment means is also seated against the moveable container.

9. The plunger according to claim 8, characterised in that in the second deployed position the base of the alignment means is substantially level with the base of the plunger.

* * * * *